US006706320B2

(12) United States Patent
Filippou et al.

(10) Patent No.: US 6,706,320 B2
(45) Date of Patent: Mar. 16, 2004

(54) METHOD FOR SURFACE ENGINEERING

(75) Inventors: Con Filippou, Caulfield (AU); Wojciech S Gutowski, Frankston (AU); David Proctor, Moorooduc (AU); Mark Spicer, Seaford (AU)

(73) Assignee: Commonwealth Scientific and Industrial Research Organisation, Campbell (AU)

( * ) Notice: Subject to any disclaimer, the term of this patent is extended or adjusted under 35 U.S.C. 154(b) by 79 days.

(21) Appl. No.: 09/780,623

(22) Filed: Feb. 12, 2001

(65) Prior Publication Data

US 2002/0018860 A1 Feb. 14, 2002

(30) Foreign Application Priority Data

Jul. 6, 2000 (AU) ..... PQ8590

(51) Int. Cl.[7] ..... B05D 3/08

(52) U.S. Cl. ..... 427/223; 427/248.1; 427/255.23; 427/255.26; 427/255.27; 427/255.28; 427/255.6; 427/399; 427/400

(58) Field of Search ..... 427/223, 248.1, 427/255.23, 255.26, 255.27, 255.28, 255.6, 399, 400

(56) References Cited

U.S. PATENT DOCUMENTS

| | | | | | |
|---|---|---|---|---|---|
| 4,543,275 | A | | 9/1985 | Akashi et al. | 427/250 |
| 4,588,609 | A | | 5/1986 | Leyden et al. | 427/54.1 |
| 4,639,379 | A | | 1/1987 | Asai et al. | 427/40 |
| 4,815,962 | A | | 3/1989 | Cardone | 427/38 |
| 4,842,893 | A | * | 6/1989 | Yializis et al. | 427/44 |
| 4,959,009 | A | * | 9/1990 | Hemsath | 431/1 |
| 5,487,920 | A | | 1/1996 | Lopata et al. | 427/489 |
| 5,571,869 | A | * | 11/1996 | Lee et al. | 525/322 |
| 5,652,021 | A | * | 7/1997 | Hunt et al. | 427/248.1 |
| 5,725,909 | A | | 3/1998 | Shaw et al. | 427/412.1 |
| 5,879,757 | A | * | 3/1999 | Gutowski et al. | 427/491 |
| 5,900,317 | A | * | 5/1999 | Strobel et al. | 428/412 |
| 5,922,161 | A | * | 7/1999 | Wu et al. | 156/272.6 |

FOREIGN PATENT DOCUMENTS

| | | |
|---|---|---|
| GB | 1 457 720 | 12/1976 |
| JP | 06305 W | 5/1974 |
| JP | 01143 J/47 | 10/1982 |
| JP | 62110 E/30 | 10/1982 |
| JP | 93-232466/29 | 12/1991 |
| WO | WO 93/24243 | 12/1993 |
| WO | WO 97/31034 | 8/1997 |
| WO | WO 97/35912 | 10/1997 |
| WO | WO 99/16931 | 4/1999 |
| WO | WO 99/51471 | 10/1999 |

* cited by examiner

*Primary Examiner*—Michael Barr
*Assistant Examiner*—Elena Tsoy
(74) *Attorney, Agent, or Firm*—Pillsbury Winthrop LLP

(57) ABSTRACT

A process for modifying the surface of a substrate containing a polymeric material by contacting the surface with the modifying agent to bond the modifying agent to the surface the process comprising providing a solution of the modifying agent in a solvent and subjecting the solution of the modifying agent to a zone of elevated temperature to vaporize the solvent and provide diffuse contact between the modifying agent and the surface of the substrate.

34 Claims, 6 Drawing Sheets

METHOD FOR SURFACE ENGINEERING

The present invention relates to a method and apparatus for modifying the surface of substrates comprising polymeric material.

BACKGROUND OF THE INVENTION

The surface properties of materials dictate the way in which they interact with their surroundings. This is particularly the case for surfaces containing solid organic polymers whose surface properties dictate to a large extent their useful applications. Some of the significant properties influenced by the structure and chemical properties of the surface include the quality of adhesion of adhesives, surface coatings, inks and other specialty or commodity materials, wettability, friction, permeability, gloss, corrosion, electrostatic and electroconductive properties and biocompatibility. Substrates exhibiting inert or insufficiently reactive surfaces such as polyolefins are particularly resistant to surface modification. Other types of polymeric materials containing more reactive functional groups often require additional surface modification in certain applications or to obtain optimum results.

There is a need for a processes and apparatus which will allow the surface properties of polymers to be tailored for a range of applications or applications or where special properties are required. The problem of inappropriate surface properties can in some instances be overcome by using a different material for construction of the substrate. In many instances, however materials that provide the desired bulk properties do not exhibit the required surface reactivity.

A number of processes have been developed for surface modification. Examples of surface modification techniques include:

(i) surface oxidation by methods such as electrical discharge, flame treatment, plasma, ozone, UV radiation, oxidizing or halogenating gases or liquids and excimer lasers;

(ii) surface functionalisation by: plasma treatment with reactive gases and/or reactive monomers and polymers; and (iii) surface grafting, for instance by: (a) surface activation eg by the means of oxidation and/or other processes or means such as halogenation, and the deposition of specific graft chemicals, or by: (b) UV grafting and/or (c) other means known to those skilled in the art of surface modification.

Examples of such processes as listed in (i) to (iii) above are described in detail in our earlier inventions including U.S. Pat. Nos. 5,879,757; 5,922,161; 5,892,190, International Patent Applications: PCT/AU 00/01272 and another one based on Australian Provisional Patent Application PQ 5449, and Australian Patent Applications: PQ 8097, PN 3698 and PN our recently filed Australian provisional patent/application entitled "Composition and method for providing an electroconductive surface to a polymeric substrate"), the contents of which are incorporated by reference.

The present invention relates to a method and an apparatus for modifying the surface structure of a substrate by surface activation means and the deposition of specific surface modifying agents. The surface modifying agent may be of the type referred to in our previous applications and may include monomers, polymers and/or other macromolecules.

SUMMARY OF THE INVENTION

The invention provides a process for modifying the surface of a substrate containing a polymeric material by contacting the surface with the modifying agent to bond the modifying agent to the surface the process comprising providing a surface modifying agent composition comprising the surface modifying agent and optionally a carrier therefore and subjecting the surface modifying agent composition to a zone of elevated temperature to vaporize the surface modifying agent composition to provide diffuse contact between the modifying agent and the surface of the substrate.

The surface modifying agent composition may comprise undiluted surface modifying agent however it is preferred that the surface modifying agent composition further comprise a carrier such as a solvent for the surface modifying agent.

In accordance with a preferred aspect we provide a process for modifying the surface of a substrate containing a polymeric material by contacting the surface with the modifying agent to bond the modifying agent to the surface, the process comprising providing a solution of the surface modifying agent in a solvent and subjecting the solution of the modifying agent to a zone of elevated temperature to vaporize the solution of the surface modifying agent and provide diffuse contact between the modifying agent and the surface of the substrate.

We have found that the process of the invention has the significant advantage over conventional processes in that it provides bonded functional groups at the surface which significantly improve the quality of desired interaction of the surface with other materials with which it is to interact. The process provides diffuse contact between the surface modifying agent and substrate allowing precise and consistent application over an area of surface and establishes a strong bond with the surface. Without wishing to be bound by theory we believe the process produces an approximately monolayer of surface modifying agent reducing the incidence of weak boundary layers that may comprise excessive amount of adsorbed, instead of just chemically bound surface modifying agent which in turn can adversely interfere with the quality of attachment of other materials such as paints, inks, bioactive materials and others to the surface of the substrate modified by processes other than that of the current invention.

The composition of the modifying agent may be heated to a temperature above the boiling point of the composition. This may be above the boiling point of the solvent where present and/or above the boiling point of the modifying agent. The heating may occur prior to contacting the modifying agent with the surface of the substrate. Alternatively the of the modifying agent composition or may be heated to a temperature above the boiling point of the solvent and/or that of the modifying agent on or adjacent to the surface of the substrate. In some cases, for example where the substrate is sensitive to heat such as thin plastics firms the zone of elevated temperature may be at a suitable distance from the substrate.

The heating zone typically provides a temperature of at least 60° C. and less than 3000°. The heating zone will preferably provide a temperature of at least 120° C. and more preferably in the range of from 120 to 2300°. The optimal maximum will depend on the nature of the surface modifying agent and its decomposition temperature as well as the type of the carrier solvent used for diluting the modifying agent. If the solution of the modifying agent or an undiluted modifying agent is heated on the surface of the substrate then the effect of temperature on the substrate will also need to be considered.

The heating zone may be provided by a range of means including direct heating using a suitable heat exchanger or flame or other combustion method such as a standard combustion provided by a standard or modified flame treater comprising a standard flame burner or its multiplicity, or pulsed combustion burner or pulsed plasma torch, or by indirect heating means such as microwave or gliging arc otherwise known as corona jet, or laser treatment. The heating zone may be provided by a burner which can be of any known type and geometry such as but not limited to linear, curvilinear or cylindrical with the flame delivered through a singular or a plurality of continuous or individual flame zones of any shape and dimensions. Most preferably the heating zone is selected from the group consisting of a standard flame treatment zone and/or a pulse combustion burner or chamber and the associated flame treatment zone.

In a particularly preferred embodiment the invention provides a process for modifying the surface of a substrate wherein the modifying agent is applied to a heating zone adjacent to the surface of the substrate to produce vapor atmosphere in contact with the surface of the substrate. A flame or other suitable means may produce the heating zone in this embodiment but we have found that particularly good results are obtained using a combustion device such as burner. The combustion device may include a mixing and/or combustion chamber for providing appropriate mixing of the combustible gases with an oxidant such as air or oxygen, and combustion therein and/or outside the chamber, and an opening and optionally a single or multiple valve(s) for admitting the combustible gases or other fuel and an oxidant such as, but not limited to, air or oxygen therein. The combustion burner will typically include fuel supply means and may include a mixing chamber and an exhaust, the latter being used for removing hot combustion products when the combustion takes place within the combustion chamber, and/or to transfer the combustible gas/air mixture to the outside of the burner if the combustion is to take place at the exhaust end of the burner as it typically happens in a standard flame treating equipment commonly known by those skilled in the art of surface treatment of polymers.

The fuels used are generally hydrocarbons such as liquid propane, butane LPG, natural gas and their mixtures but could also include hydrogen or other combustible fluid mixtures. The combustion burner may further include valve means for controlling the flow of fuel and oxidizing agent such as air or oxygen.

The combustion chamber may be a separate component of the apparatus of the invention and may, in one embodiment, include the exhaust pipe and/or a pressure equalising device and/or flame director. In yet another embodiment of the invention the combustion process or any part of it can be taking place outside the mixing and/or pressure equalising and flame forming/delivery device, which is commonly known to those familiar in the art of surface treatment of polymers as a flame treater or flame burner.

In the most preferred example of this embodiment of the invention the combustion burner is a pulse combustion burner. Pulse combustion is produced as a consequence of combustion instability which is induced to drive it into to resonance of discrete flamelets each ignited by the combustion products of previous flamelets. The combustion products of each flamelet produce a back pressure and valves controlling the oxidizing agent and fuel may be adapted to close in the presence of the pressure until a negative pressure produced by the flow of exhaust gases from the exhaust. Pulse combustion is normally avoided by combustion engineers but we have found that it provides significant advantages in the process of the present invention.

The pulse combustion burner may essentially comprises a mixing and combustion chamber with an open, single or multiple, tailpipe at one or more side(s) of the chamber, and a single valve or a set of two valves at the other end or side of the chamber. The valves control the flow of an oxidant such, as but not limited to, air and a combustible gas or other fuel and/or that of their mixture into the chamber. The examples of such combustible gases are, but not limited to the following: natural gas, propane, butane, LPG, hydrogen, and any of their mixtures.

The tailpipe, which is typically either or both, narrower than the combustion chamber and/or has the effective outlet area controlled by the means of singularity or plurality of openings, such as but not limited to, individual slots or holes, acts as an exhaust for the hot combustion products which may comprise, in part or entirety, the products of combustion and the tail of the flame produced in any part of the device comprising the said pulse combustion chamber. The said flame and/or combustion/exhaust products resulting from the said pulse combustion constitute the medium useful for the purpose of oxidising or activating the surface of the object with the use of the method and the apparatus of this invention.

The combustion in the pulse burner is started by supplying the combustible gas/air mixture through a valve or by supplying air through one valve and gas through the second valve, under controlled flow rates, flow speed and pressure. The gas/air mixture is ignited by an electrical spark. A positive pressure is created by the combustion gases causing the valve(s) to close. The combustion products exit through the exhaust pipe, which may comprise a part or the entirety of the burner, due to the positive pressure wave. The combustion cycle is followed by a contraction in the system which produces a momentary negative pressure in the chamber allowing the valve(s) to open and admit a new portion of a combustible mixture or the mixture's ingredients. The fresh charge automatically ignites, frequently without the need for further use of a spark ignition, and the cycle repeats itself. The number of cycles per second depends on the dimensions and the geometry of the system, particularly the length and other parameters of the tail pipe and/or the geometry and design details of the burner. A pulse combustion burner may be effectively used as means of oxidizing or preferably surface engineering of the surface of the treated object by the use of the apparatus and the method of this invention.

The valves controlling the admission of fuel such as flammable gas and an oxidant such as air or oxygen and/or their mixture into the combustion chamber of a pulse burner may be also controlled by an aero-valve or piezo-electrically or electro-magnetically controlled valve, or by any other type of device known to be able to control the frequency.

In one embodiment of this invention, the said flame and exhaust products, due to embodied heat energy and kinetic energy of exhaust products and gases, are used for delivering and/or contacting the graft chemicals and/or other functional chemicals or materials with the surface of the material or object modified in accordance with this invention.

In another embodiment of this invention the surface modifying agent and/or other chemicals and materials are admitted in the form of solutions, sprays, dispersions, pure chemicals, vapours, suspensions comprising liquids and solids, or in any combination of thereof directly into the flame and/or into its vicinity where the liquid ingredients are evaporated partially or in their entirety. The heat energy embodied in the flame and/or exhaust gases is used to heat and evaporate any or all ingredients of such solutions, sprays, dispersions, vapours or pure chemicals. This exposure of the surface modifying agent to the heat energy embodied in the flame and/or exhaust gases is carried out under such conditions that excessive thermal decomposition or destruction of said chemicals or materials is avoided, so that upon chemical attachment or grafting to the object surface of the said chemicals and materials, these chemicals and materials are still chemically reactive and useful for the purpose of the intended use of the product modified with the use of the method and apparatus of this invention.

Typically the resonant frequency of pulses in the pulse combustion burner used in the invention will be in the range of from 1 Hz to 20000 Hz and more preferably in the range of from 20 Hz to 1000 Hz.

The modifying agent may be applied to the surface of the substrate before, during or after the solution of the modifying agent passes through the heating zone. In one example the solution of surface modifying agent is applied to the surface of the substrate and is subsequently heated.

More preferably however the solution of modifying agent is vaporized in the heating zone and the resulting vapor is contacted with the surface of the substrate. The solution of modifying agent may be applied as a spray, aerosol, mist jet, or other form to the heating zone.

In another embodiment of this invention the surface modifying agent and/or other functional chemicals are admitted to a combustion burner having one or more combustion chamber. The solution of surface modifying agent may be introduced to any part of the burner including the combustion chamber or other components of the combustion burner. The combustion burner may include a single or multiple exhausts. The said graft chemicals and materials may contact any surface of the interior or exterior of any component of the apparatus or such contact may be minimised by applying the solution to the interior or exhaust gas.

The surface modifying agent may be are admitted by any known means such as spray, vapour or any mechanically or chemically achieved dispersion or gaseous product directly into the flame zone within and/or outside the combustion chamber or device and/or outside the burner or other combustion device. The said admission of said chemicals is directly into any part of the flame and/or combustion products, or into the vicinity of such flame and/or the zone comprising the flame and/or combustion products.

The composition of the combustible and other gases or fuel mixture is such that preferably excess of oxygen is present in the said mixture of gases or fuel and said graft chemicals and/or other functional chemicals in such manner that at any or all stages of the combustion process and in particular in any or all parts of the flame and/or exhaust products resulting from the combustion this excess oxygen is present and used in the process according to this invention so that the surface of the modified object can be oxidized prior to and/or during contacting the said chemicals in the form of gas, vapour, dispersion or other form with the oxidised surface or during oxidising the surface of the object modified with the use of the method and the apparatus of this invention.

The combustion devices and equipment and/or flame burners used in this embodiment of the invention can be of any type commercial equipment including of flame treaters and burners is available from a range of sources including Arcotec, Aerogen, Flynn, Sherman, Ecci, Wise, and other suppliers.

In one particular and novel embodiment of this invention, any type of a pulse combustion burner or device can be used. The examples of these are, but not limited to, as follows: a pulse combustion device embodied in our earlier inventions according to Australian Patent Applications PQ 8097 and PN 3698, or that described in the U.S. Pat. No. 5,834,095 such as Lennox G 14 series unit or alternative units available from Lennox Corporation, all of each are incorporated here by reference.

All pulse combustion devices such as those referred to above, can be used in any part of the apparatus of the invention, and in some embodiments may be additionally modified to further facilitate the delivery of the process according to this invention.

The method of the invention may and preferably will include oxidizing the polymer at the surface of the substrate. When the solution of modifying agent is heated on or adjacent the surface of the substrate the surface of the substrate may be heated in the heat treatment zone under conditions to provide surface oxidation. Alternatively or in addition to oxidizing the surface of the substrate under heat the substrate may be subject to surface oxidation using heat or other suitable means.

One of the preferred oxidising means or media according to this invention are combustible gases and/or their mixtures with air and/or oxygen the latter of which can be present as an inherent ingredient of the air, or may become available as a result of an admission of gaseous oxygen to a combustible gas or which may be released as a result of a decomposition eg. thermal or other type of chemical reaction of appropriate reagents in the, or into the apparatus according to this invention.

In one embodiment of this invention oxidation is performed using combustible gases and/or their mixtures with air or oxygen, the solution of modifying agent is admitted into the combustible mixture of fuel and oxidizing agent or into one or more of its individual ingredients prior to admitting any or all of these to the combustion zone or combustion chamber. This may be accomplished for instance by admitting the solution of surface modifying agent and into a part of the supply line which subsequently admits the components of the combustible mixture to any part of the apparatus including, but is not limited to, a mixing chamber or device and/or any part of the combustion chamber.

Many suitable methods are known to modify at least part of a polymer surface to improve the interaction of the polymer surface with polyamino compounds. The most common treatment is oxidation of the polymer surface but other surface modification methods such as sulfonation with sulfur trioxide gas, or halogenation can also lead to a surface suitable for the grafting of polyamino compounds. Surface oxidation techniques which can be used for this invention include for example corona discharge, flame treatment, atmospheric plasma, non-depositing plasma treatment, chemical oxidation, UV irradiation and/or excimer laser treatment in the presence of an oxidising atmosphere such as: air, oxygen ($O_2$), ozone ($O_3$), carbon dioxide ($CO_2$), Helium (He), Argon (Ar), and/or mixtures of these gases. However, for the present technique of an electrical discharge for instance corona discharge or atmospheric plasma, flame treatment, chromic acid treatment, halogenation or combination thereof are preferred.

Suitable corona discharge energies range from 0.1–5000 $mJ/mm^2$ but more preferably 2–800 $mJ/mm^2$. Corona discharge treatment may be carried out in the presence of the following atmospheres: air, oxygen ($O_2$), ozone ($O_3$), carbon dioxide ($CO_2$), Helium (He), Argon (Ar), and/or mixtures of these gases. Suitable treatment times and discharge energies can be calculated using the following equations:

$$t=d/v_1(\text{or } v_2)$$

and $$E=Pn/lv_1$$

or $$E=Pn/lv_2$$

t=treatment time for a single pass of treatment under the electrode d=electrode diameter E=discharge energy P=power energy n=number of cycles of treated substrate moving under the electrode l=length of treating electrode $v_1$=speed of treating table $v_2$=speed of conveyor tape (i.e. continuous treatment)

When non-depositing plasma glow discharge treatment is used, the range of suitable energy is 5–5000 Watts for 0.1 seconds to 30 minutes, but more preferably 20–60 Watts for 1 to 60 seconds. Preferable gases are air, oxygen, water or a mixture of these gases.

Alternatively, any known flame treatment may be used to initially oxidize at least part of the surface of the polymer or polymer based material. The range of suitable parameters for the flame treatment are as follows: the oxygen ratio (%) detectable after combustion from 0.05% to 5%, preferably from 0.2% to 2%; treatment speed from 0.1 m/min to 2000 m/min, preferably from 10 m/min to 100 m/min; treatment distance from 1 mm to 500 mm, preferably from 5 mm to 100 mm. Many gases are suitable for flame treatment. These include, but are not limited to: natural gases, pure combustible gases such as methane, ethane, propane, hydrogen, etc or a mixture of different combustible gases. The combustion mixture also includes air, pure oxygen or oxygen containing gases. Similarly, chemical oxidation of at least part of a polymer surface can be effected with any known, standard etching solutions, such as chromic acid, potassium chlorate-sulfuric acid mixtures, chlorate-perchloric acid mixtures, potassium permanganate-sulfuric acid mixtures, nitric acid, sulfuric acid, peroxodisulphate solution in water, chromium trioxide, or a dichromate solution in water, chromium trioxide dissolved in phosphoric acid and aqueous sulfuric acid, etc. More preferably, chromic acid treatment is used. The time taken to complete the treating process can vary between 5 seconds to 3 hours and the process temperature may vary from room temperature to 100° C.

Alternatively, halogenation may be used to modify at least part of polymer surface with a halogenating agent to improve the interaction of polymer surface with polyamino compounds. The halogenation treatment is more preferable for polymer being any natural or synthetic rubber. Suitable halogenating agent may be an inorganic and/or organic halogenating agents in an aqueous or nonaqueous or mixed solvents.

Suitable inorganic halogenating agent include but not limited to fluorine, chlorine, iodine, and bromine as pure gas or any mixture with nitrogen, oxygen, argon, helium or in solutions and acidified hypochlorite solutions. Suitable organic halogenating agents include but not limited to N-halohydantoins, N-haloimides, N-haloamides, N-chlorosulphonamides and related compounds, N, N'-dichlorobenzoylene urea and sodium and potassium dichloroisocyanurate. Specific examples are 1,3-dichloro-5,5-dimethyl hydantoin; 1,3-dibromo-5,5-dimethyl hydantoin; 1,3-dichloro-5-methyl-5-isobutyl hydantoin; 1,3-dichloro-5-methyl-5-hexyl hydantoin, N-bromoacetamide, tetrachloroglycoluril, N-bromosuccincimide, N-chlorosuccinimide, mono-, di-, and tri-chloroisocyanuric acid. Trichloroisocyanuric acid is especially preferred. The halogenation may be carried out at room temperature or at elevated temperature in gas phase or in solution with or without the use of ultrasonication energy. More specified treatment conditions are referred to U.S. Pat. No. 5,872,190 and the related prior art.

The current invention provides novel means and an apparatus for effective surface engineering and functionalising the surfaces of materials and respective products such as, but not limited to those made of polymers and polymer-based composites, as well as metals and their alloys, ceramics, semi- and super-conductive materials and others.

Substrate

The substrate contains a polymeric material. The substrate may also contain aggregates and composites.

We have also discovered that the method and the apparatus of the current invention are suitable for surface modification of non-polymeric materials such as, but not limited to, metals and ceramics or semi-conducting and/or other materials.

The current invention provides novel means and an apparatus for effective surface engineering and functionalising the surfaces of materials and respective products such as, but not limited to those made of polymers and polymer-based composites, as well as metals and their alloys, ceramics, semi- and super-conductive materials and others.

By the term "polymeric material or polymeric substrate", as used herein, we mean homo-polymers, co-polymers, natural and synthetic rubbers and their blends and alloys with other materials such as inorganic fillers, and matrix composites. These polymeric materials may be used as materials on their own or alternatively as an integral and uppermost part of a multi-layer laminated sandwich comprising any materials such as polymers, metals, ceramics or an organic coating on any type of substrate material. The term "polymer" includes thermoset and thermoplastic polymers and mixtures thereof.

Examples of the polymeric materials suitable for surface modification by this invention include: polyolefins such as low density polyethylene (LDPE), polypropylene (PP), high density polyethylene (HDPE), ultra high molecular weight polyethylene (UHMWPE); blends of polyolefins with other polymers or rubbers or with inorganic fillers; polyethers, such as polyoxymethylene (Acetal); polyamides, such as poly(hexamethylene adipamide) (Nylon 66); halogenated polymers, such as polyvinylidenefluoride (PVDF), polytetra-fluoroethylene (PTFE), fluorinated ethylene-propylene copolymer (FEP), and polyvinyl chloride (PVC); aromatic polymers, such as polystyrene (PS); ketone polymers such as polyetheretherketone (PEEK); methacrylate polymers, such as polymethylmethacrylate (PMMA); polyesters, such as polyethylene terephthalate (PET); polyurethanes; epoxy resins; and copolymers such as ABS and ethylenepropylenediene (EPDM). Natural or synthetic rubber referred to in this patent includes pure rubber, mixture of rubber blends or alloys of rubber with polymer. The rubber can be in virgin or vulcanized or crosslinked form while vulcanized rubber is preferable. Suitable rubbers and rubber based materials for use in the invention include, but are not limited to, natural rubber, ethylene-propylene diene rubber, synthetic cis-polyisoprene, butyl rubber, nitrile rubber, copolymers of 1,3-butadiene with other monomers, for example styrene, acrylonitrile, isobutylene or methyl methacrylate, and ethylene-propylene-diene terpolymer. The term "vulcanized rubber" as used herein includes vulcanised rubbers and vulcanized rubbers mixed with fillers, additives, and the like. Examples, of filler and additives include carbon black, silica, fiber, oils, and zinc oxide.

Suitable polymer surfaces for the application of polyamine formulation of the current invention also include polymer containing surface reactive groups of type carboxylic, hydroxyl, anhydride, ketone, ester and epoxy introduced through bulk modification and blend with polymer containing these functionalities. The bulk modification includes but not limited to bulk grafting or reactive extrusion of polymers with monomers containing unsaturated groups such as glycidyl(meth)acrylate, maleic anhydride, maleic acid, (meth)acrylate ester. Preferable polymers are polyolefins grafted with maleic anhydride or maleic acid and glycidyl(meth)acrylate such as commercial product of polypropylene-graft-maleic anhydride, polyethylene-graft-maleic anhydride, poly(ethylene-co-glycidyl methacrylate). Typical polymer blends include polymer blended with maleated polyolefin, homopolymer or copolymer of glycidyl (meth)acrylate or maleic anhydride such as commercial products of poly(ehtylene-alt-maleic) anhydride, poly (isobutyl-alt-maleic anhydride), poly(ethylene-co-vinyl acetate)-graft-maleic anhydride.

The polymer materials to be treated may be in the forms of flat sheets, films, complex shaped articles, particulate or powders, woven or non-woven fabrics, individual fibers and mixtures thereof. These can be solid polymeric mono-materials, laminated products or hybrid materials, or alternatively organic coatings on any type of base substrate that can be non-metallic or metallic in nature.

The invention may also be used to modify the surface of substrates comprising natural polymeric materials.

The natural polymeric material used for this embodiment of the invention includes polysaccharides of which two of the most important examples are cellulose and starch based materials. Both are derived from plant based matter and for such materials, other material that naturally occurs in plant based materials may also be present. Protein based polymers are also included in this invention. For example, but not limited to, materials based casein or wheat gluten products. Natural polymeric materials may also be based on monomers found in biological systems but are prepared synthetically, one example being polymers or copolymers based on lactic acid. Natural polymeric materials produced by microorganisms may also be used in the method of the invention. Examples of such materials are, but not limited to, polyhydroxy alkanoates such as polyhydroxybutarate, polyhydroxyvalerate or copolymers containing hydroxy alkanoic acids.

The natural polymeric materials can come in a number of forms which includes fibers, particulate, sheet (eg paper), plate, board or a shaped article.

Cellulosic materials are materials which are or contain polymerized substances derived from glucose which may be associated with other natural materials such as lignin. Cellulosic materials include natural fibers of vegetable origin and products formed from these natural materials by processing into forms such as of lumber, finished timber, planks, flat sheets, films, complex shaped articles, particulate form, textiles, woven or non-woven fabrics, cordage, brushes, mats, paper, individual fibers and mixtures thereof. These can be solid mono-materials, laminated products or hybrid materials. Cellulosic fibers or wood chips may be used in composites or reconstituted wood products, particle board, laminates, wood composites, rayon and plant fibers. Examples of plant fibers which may be treated includes kemp, jute, flax, kenaf, ramie, sunn, cadillo, seed-hair fibers such as cotton, kapok, crin vegetal, sisal and piassava.

The preferred cellulosic materials are products from perennial plants such as wood or wood-based products or any type of cellulose-based fibers or their compounds with other synthetic or natural polymers. These polymeric materials may be used as materials on their own or alternatively as part of a composite or assembly. For example a cellulosic material layer may form the uppermost part of a multi-layer laminated sandwich comprising any materials such as polymers, metals, ceramics or an organic coating of or any type of substrate material. The term "synthetic polymer" e.g. used as a matrix can be any thermoset or thermoplastic material or mixtures or blends thereof.

Examples of preferred cellulose-based substrates include softwoods, hardwoods, leaf (hard) fibers such as abaca, cantala, caroa, henequen, istle (generic), Mauritius, phormium, bowstring hemp, and sisal; Bast (soft) fibers such as China jute; flax, hemp, jute, kenaf, ramie, roselle, sunn and cardillo; Seed-hair fibers such as a cotton and kopok; Miscellaneous fibers such as broom root (roots); coir (coconut husk fiber), crin vetetal (palm leaf segments), piassava (palm leaf base fiber); viscose (cord) and softwood kraft.

Typical examples of softwood include Western redcedar, Cypress, Redwood, Eastern white pine, Ponderosa pine, White fir, Western hemlock, Spruce, Douglas fir and Southern yellow pine. Typical examples of Hardwood include, Eastern cottonwood, Magnolia, Yellow poplar, Locan (plywood), Yellow birch, Gum, Sycamore, American elm, White oak, Northern red oak.

Cellulosic materials include derivatives of cellulose such as cellulose ethers and esters such as cellulose acetate fibers that comprise partially or fully acetylated cellulose.

There have been a large number of papers published over the years dealing with structure and properties of man-made cellulosic materials, particularly rayon fibers.

According to this invention, the surface of a material and/or respective object can be functionalised by appropriate graft chemicals or functional chemicals that are applied with the use of the method and apparatus of this invention. The examples of such suitable graft chemicals and/or functional chemicals are, but not limited to the following: organo-functional coupling agents eg. organo-silanes, organo-titanates, organo-zirconates and/or other types of functional chemicals such as polyfunctional amines of any type described in our earlier patents and patent applications, and also other chemicals not covered by our earlier inventions. The examples of other types of functional chemicals and/or materials suitable for the use in accordance with our inventions are, but not limited to, as follows: other adhesion-promoting mono- and polyfunctional chemicals, electroconductive and/or charge conducting/retaining molecules and materials, chemicals and materials exhibiting barrier properties, energy absorbing and/or reflecting molecules and materials, bio-functional molecules and materials and others.

The method according to this invention is implemented by exposing the said chemicals and/or their solutions and/or any type of mechanically or chemically prepared/modified dispersion comprising the said chemicals such as vapour or aerosol or dispersion as well as other functional materials to the appropriately and sufficiently heated and/or ionised media such as but not limited to fluids such as gases and/or mixtures of various gases and/or their mixtures with vapours any of which or all of which are capable of oxidizing and/or otherwise activating the surface of the modified material or respective object and contacting the said chemical in the form of gas, vapour, dispersion, spray, or a combination of any of thereof with the oxidized and/or otherwise activated surface of the material or object subjected to surface modification in accordance to this invention.

One of the preferred oxidising means or media according to this invention are combustible gases and/or their mixtures with air and/or oxygen which can be present as an inherent ingredient of the air, or may become available as a result of an admission of gaseous oxygen to the combustible gas or which may be released as a result of a decomposition e.g. thermal or other type of chemical reaction of appropriate reagents in the, or into the apparatus according to this invention.

One other preferred oxidising means or media according to this invention are ionised gases the examples of which are, but not limited to, as follows: air, oxygen, ozone, carbon dioxide, helium, argon, and/or the mixtures of any of these gases.

The device, according to the current invention comprises one or more components selected from the group of:

(a) surface modification device comprising one or more of the following: surface activation and graft chemical/functional chemical delivery means such as, but not limited to, a surface oxidation device and graft chemical/functional chemical delivery device, the said means comprising one or both of these devices and/or their multiplicity;

(b) means for providing relative motion of the surface of the object to be modified with respect to a surface modification device as described in (a) above, or alternatively by the means for providing relative motion of the surface modifying device as described in (a) above in relation to the surface of the object to be modified in accordance to this invention;

(c) means for application of and/or contacting graft chemicals and/or functional chemicals to and/or with the surface to be modified optionally further including means for generation of a suitable form of said graft chemicals wherein the means for generation of a suitable form may include gas and/or steam and/or liquid—liquid and/or gas-liquid and/or liquid-solid and/or gas-solid and/or any other known form of chemical or mechanical dispersion, suspension, vapour and/or aerosol or a mixture of any of these, provided and/or admitted from an external source or created by a suitable generator;

(d) static and/or dynamic physical field and or pulse generator; and (e) means for post processing, eg. chemical application and/or finishing, processing, drying and/or other device.

The preferred apparatus includes at least one said means for providing relative motion, said surface modification device comprising any activation means and said means for delivery or application of graft chemicals and/or other functional chemicals or materials and/or other processing means as described in (a) to (e) above. The graft chemicals to be applied by the apparatus may be mono and/or poly functional chemicals such a those disclosed in the above-mentioned US patents.

The said surface modification devices such as described in (a) above and in particular the surface activation means and/or graft chemical/functional chemical admission/delivery means are provided, in accordance with this invention, by a single or multiple device capable of providing of either or all: static, continuous or dynamic/pulsating mode of delivery of surface activation means for instance surface oxidation such as but not limited to corona discharge, plasma, glowing arc, flame and/or other forms of ionisation, combustion, UV, laser. The examples of gliding arc are embodied in the form but not limited to corona jet devices such as those manufactured by Arcotec, Ahlbrandt, Tantec, Arcojet, Lectro Engineering and others.

Pulsating flame and pulsating combustion devices are such, as described in but not limited to our earlier inventions embodied in Australian Patent Applications PQ 8097 and PN 3698, and including further improvements of these as described in the current invention.

Corona discharge, UV devices, electron beam sources and lasers are known to those skilled in the art of surface modification from ample literature.

The Modifying Agent

The functionality of the surface modifying agent(s) is chosen to provide good adhesion with the natural polymeric material as well as providing a surface chemical reactivity which is compatible with that of adhesive, paint, metallic coating or other material to be brought into contact with surface-modified material.

The process allows for continuous and inexpensive incorporation of a wide range of surface functional groups onto the surface of a polymeric substrate with relatively minor adaptation of factory plant and equipment. This provides the possibility of tailoring the surface chemistry of a natural polymeric material, without altering its bulk properties, in order to optimize the adhesion between the surface engineered substrate and adhesive, paint, printing ink or other materials.

The method of the invention may be used to improve adhesion to a wide range of adhesive coating compositions and lacquers. Examples of resins for use with natural polymeric material modified in accordance with the invention include epoxies, acrylate, urethanes, cyanoacrylates, melameic formaldehyde and ureaformaldehyde.

The invention is useful in improving the adhesion of cellulosic material to paints and lacquers various resins in the form of matrix materials, preservation and other media providing required product performance. Suitable paints and lacquers include polymer latex, alkyds and polymethane lacquers.

The modifying agent may be a coupling agent such as those selected from organo titanates, organo silanes and organo zirconates. Particularly preferred coupling agents are of formula $X_a$SiYb, wherein X is an non-hydrolyzable organo-functional alkyl group, Y is a hydrolysable group, a is an integer from 1 to 3, and b is 4-a. In a particularly preferred group the organofunctional silane has the structure X.aSi(OR)b where X is an non-hydrolyzable organofunctional group bonded to silicone through a stable covalent bond, R is any suitable alkyl group, preferably methyl or ethyl, a is an integer from 1 to 3 and b is 4-a. The silanol groups obtained after hydrolysis of the alkoxy groups may react with the hydroxyl and/or other functional groups introduced onto the surface of the polymer.

Another preferred group of modifying agents are multifunctional amine-containing organic compounds. Such compounds will include a primary or secondary amino group and one or more other functional groups such as primary amino, secondary amino, alcohol, phenol, saccharide group or groups, carboxylic acid, aldehyde, ketone, amide, ether, ester, nitrile, nitro, thiol, phosphoric acid, sulphonic acid, halogen and unsaturated groups. Preferred modifying agents of this group include multifunctional amine containing compounds selected from the group consisting of $C_2$ to $C_{36}$ linear, branched or cyclic compounds containing two or more amine groups; polymers of a number average molecular weight of from 300 to 3 million containing a multiplicity of amine group; $C_2$ to $C_{36}$ perfluoroamines; $C_2$ to $C_{36}$ amino alcohols/phenols; $C_2$ to $C_{36}$ amino acids; $C_2$ to $C_{36}$ amino aldehydes/ketone; $C_2$ to $C_{36}$ amino amides; $C_2$ to $C_{36}$ amino ethers; $C_2$ to $C_{36}$ amino esters; $C_2$ to $C_{36}$ amino nitros; $C_2$ to $C_{36}$ amino nitrites; $C_2$ to $C_{36}$ amino phosphoric acids; $C_2$ to $C_{36}$ amino sulfonic acids; $C_2$ to $C_{36}$ amino halogens; $C_2$ to $C_{36}$ amino alkenes; $C_2$ to $C_{36}$ amino alkynes; polymers of a number average molecular weight of from 300 to 3 million containing a multiplicity of amine groups and non-amine functional groups: amino polysaccharides, etc. Specific examples of suitable coupling agents and multifunctional amines are described in our U.S. Pat. Nos. 5,879,757, 5,872,190 and Australian Patent 680716.

The most preferred modifying agents are polyamines. The polyamine compounds used in accordance with this aspect may be any compound which contains 4 or more amine groups with at least two of these amine groups being primary or secondary amines wherein primary amines have the general formula $NH_2R$ and secondary amines have the general formula $NHR_2$, where R is an any organic fragment such as an alkyl, aryl, vinyl, substituted alkyl, substituted aryl, substituted vinyl or any mixture of these etc.

The polyamine compounds may be polymeric or non-polymeric compounds. Polymeric polyamino compounds should contain multiple amine groups, at least 4, with at least two but preferably more of these amine groups being primary or secondary amines. The molecular weight of these polymers is between 200 and 200000. In a preferred embodiment of this invention the polyamino polymers can be homopolymers containing the monomers, ethylenimine, allylamine, vinylamine, 4-aminostyrene, aminated acrylate/methacrylate, or as copolymers made from a combination of these monomers or as a copolymers containing at least one of these monomers with any other suitable monomer such ethylene, propylene, acrylate/methacrylate and ethylene oxide.

Non polymeric compounds which include linear and carbon cyclic multi amine compounds may be used. These compounds have 4 or more amine groups, with at least two of these amine groups being either primary or secondary amines. Examples of such compounds are triethylene tetraamine, tris (2-aminoethyl)amine, tetraethylene pentaamine, pentaethylene hexaamine, benzene tetraaminie.

The polyamine compounds can be used as single polyamine components or as combinations of polyamine compounds described above. A preferred embodiment of this invention is the use of PEI compounds, linear or branched with a molecular weight range of 200 to 750000, examples of which are Lupasol FC, Lupasol WF or Lupasol PS (BASF).

The concentration of the modifying agent is between 0.000001% to 50% by weight, preferably between 0.001% and 5% by weight with the most useful concentration range being 0.01% to 1% by weight.

The modifying agent may be used as a solution in a suitable solvent such as water, alcohol or other solvent. The concentration of the solution may in many cases be very dilute. For example, concentrates as low as 0.000001 may be used although concentrates of from 0.001 to 10% are preferred. The modifying agent may be applied by any available means eg vapour spray, aerosol at the time of and/or subsequent to the treatment steps such as oxidation, extraction and application of a static and/or alternating physical field.

The modifying agent may be a mixture of suitable compounds. In a preferred embodiment of the invention the surface of the oxidised polymer is treated with a first modifying agent having a relatively low molecular weight (for example from 100 to 10000) and a second modifying agent having a relatively high molecular weight. The relatively high molecular weight compound may have a molecular weight in the range of from one to eight orders of magnitude greater than the lower molecular weight compound.

Alternatively the surface of the natural polymeric material may be treated sequentially with the low and high molecular weight modifying agents.

Preferably the surface is treated with the low molecular weight agent and then the higher molecular weight agent, which may be reactive with the low molecular weight agent by virtue of the free functional groups of the grafted lower molecular weight agents.

When the combination of low molecular weight and high molecular weight modifying agents is used it is preferred that the amount of low molecular weight modifying agent is greater, preferably one to six orders of magnitude greater than the relatively high molecular weight compound.

The modifying agent may include functional groups that provide other desirable properties. Examples of these may be for instance: an inherently electroconductive group or a cluster of groups or moieties in a doped, self-doping or undoped state; UV-absorbing and/or IR absorbing groups or molecules; charge-containing and/or ion-exchanging group or molecule. Alternatively any derivative of any suitable and inherently functional, e.g. electroconductive, photosensitive; charge containing; UV and/or IR absorbing or other compound either low or high molecular weight, or polymer which was pre-reacted with a poly-functional amine-containing compound or silane to create either, low or high molecular weight, linear and/or branched, and/or hyper-branched compound may be used for grafting.

Following treatment with the polyamine the method of the invention may further include reacting the natural polymeric surface with cross linking agents or other materials to form a network at the surface of the natural polymeric material. The extent of cross-linking may be controlled to allow a certain proportion of reactive groups to remain uncross linked to provide bonding to paints or adhesives.

Crosslinkers

The process of the invention may include treating the surface of the substrate with a cross-linking agent reactive with the substrate modifying agent to provide a cross-linked polymer network grafted to the surface of the substrate.

The crosslinkers which may be used in this invention are defined as compounds or polymers that contain at least two functional groups with at least one of these groups capable of reacting with the surface modifying agent, particularly the amino groups of the polyamino compounds, so that a stable bond is formed between the surface modifying agent and the crosslinker. The other functional group on the crosslinker should be able to join at least two molecules of surface modifying agent (e.g. polyamino molecules) by either reacting with a group (e.g. the amino group) of another surface modifying agent molecule or by bond formation with the functional group of another crosslinker molecule or by reaction with a co-crosslinking compound which is defined as a compound capable of bond formation with at least two crosslinking molecules. Functional groups which are suitable for initial reaction with the polyamino group include but are not limited to epoxides, anhydrides, acid chlorides, sulfonyl chlorides, ketones, aldehydes, carboxylic acids, esters, isocyanates, vinyl groups susceptible to Michael addition reactions such as acrylate, methacrylate, acrylamide, alkyl halides, alkynes etc. The other functional group, which is responsible for the final crosslinking step can be silanes, epoxides, anhydrides, acid chlorides, sulfonyl chlorides, ketones, aldehydes, carboxylic acids, isocyanates, acrylate or methacrylate esters, alkyl halides etc.

Preferably the mass ratio of polyamino compound to crosslinker is 100:1 to 1:100 with about 10:1 to 1:10 being preferred.

The type and combination of functional groups on the crosslinker is important because the crosslinker used should enable crosslinking to take place at the surface of the polymeric substrate and minimise crosslinking before application. The crosslinking reaction can be controlled by designing a system where either:

A. initial reaction with polyamino molecules is fast but the crosslinking step is slow;

B. dilute solutions are used so that crosslinking reaction is slow and is much faster when the polyamino/crosslinker formulation is concentrated on the oxidised polymeric material;

C. a reagent is used which inhibits crosslinking in solution but once the formulation is applied to the surface the inhibitor is removed;

D. mixing of the polyamino compound and crosslinker takes place prior to application on the polymeric surface;

E. a reagent or catalyst is added to the formulation that induces crosslinking of the polyamino compound just prior to application to the polymeric substrate;

F. the polyamine compound and crosslinker are added in two steps;

G. a combination of these strategies is used.

Silane Crosslinking Agents

A preferred embodiment of this invention is the use of functionalised silanes which contain at least one organic functional group for reaction with the amine and a silane group which will condense with other silane groups upon addition of water, forming with SI—O—Si bonds for crosslinking. The general formula for the crosslinking silane is $X—Si—R^1(R^2)_2$, where 1 X is any organic fragment containing at least one of the following groups; epoxide, anhydride, acid chloride, chloroformate, ketone, aldehyde, carboxylic acid, isocyanate, acrylate or methacrylate ester, acrylamide or an alkyl halide and containing form 3 to 60 carbon atoms.

2 $R^1$ is a group susceptible to hydrolysis such as an alkoxide containing 1 to 30 carbon atoms, chloride or carboxylate containing from 1 to 30 carbon atoms.

3 $R^2$ can also be a group susceptible to hydrolysis such those selected from the group consisting of an alkoxide containing 1 to 30 carbon atoms, chloride and carboxylate containing from 1 to 30 carbon atoms, $R^2$ can also be selected from the group of alkyl, aryl, vinyl, substituted alkyl, substituted vinyl, substituted aryl or any combination of these groups containing 1 to 40 carbon atoms. $R^2$ can also be any organic fragment containing at least one of the following groups; epoxide, anhydride, acid chloride, chloroformate, ketone, aldehyde, carboxylic acid, isocyanate, acrylate or methacrylate ester, acrylamide or an alkyl halide and containing form 3 to 60 carbon atoms.

There are many silanes which can be used in this invention and in a preferred embodiment of this invention the silane is defined as $X—R^1—Si—R^2(R^3)_2$ where:

1. $R^1$ is an alkene group with the general formula $C_nH_{2n}$ where n=0 to 12 or a benzyl group with the formula $CH_2C_6H_4$.
2. X comes from the group: methacryloxy, acryloxy, acetoxy, chloride, bromide, iodide, glycidoxy, carbomethoxy, 4-chlorosulfonylphenyl, isocyanate, chloroformate, carbochloride, 3,4-epoxycyclohexyl or ureido.
3. $R^2$ is either a chloride, an alkoxy with the general formula $OC_nH_{2n+1}$ where n=1 to 12 or a carboxylate with the general formula $O_2CC_nH_{2+1}$ where n=1 to 11.
4. $R^3$ comes from the group chloride, alkoxy with the general formula $OC_nH_{2n+1}$ where n=1 to 12, phenyl, cyclohexyl, cylclopentyl and alkyl with the general formula $C_nH_{2n+1}$ where n=1 to 12.

The crosslinking silanes of this invention can be used in any combination as well as in partially or fully hydrolysed states as expected after exposure to water. Also one or more co-crosslinking silanes may be added to the polyamino silane crosslinking formulation. It is not necessary for the co-crosslinking silane to directly attach itself to the polyamino compound as it will be incorporated into the grafted interphase during the crosslinking processes via Si—O—Si bonding with the crosslinking silane directly bonded to the polyamino compound. The co-crosslinking silane is a compound that contains one or more silane groups which are defined by the general formula $SiR^1R^2R^3R^4$ where:

1. $R^1$ and $R^2$ are hydrolysable groups such as alkoxides with the general formula $OC_nH_{2n+1a}$, where n=1 to 12, chlorides or carboxylates with the general formula $O_2CC_nH_{2n+1}$ where n=1 to 12 and
2. $R^3$, $R^4$ can also be hydrolysable groups such as alkoxides with the general formula $OC_nH_{2n+1}$ where n=1 to 12, chlorides or carboxylates with the general formula $O_2CC_nH_{2n+1}$ where n=1 to 12. $R^3$, $R^4$ can also be alkyl, aryl, vinyl, substituted alkyl, substituted vinyl, substituted aryl or any combination of these groups containing 1 to 40 carbon atoms.

Aldol Condensation Products as Crosslinkers

In another preferred embodiment the organic crosslinking agent can contain aldeheyde or ketone functional groups or combinations thereof which can polymerize by an aldol condensation process and the resulting oligomers or polymers can act as crosslinkers for polyamino compounds. Examples of such crosslinking agents are glutaraldehyde, methyl or ethyl-pyruvate, pyruvic aldehyde, methyl or ethyl-levunate. Also mixtures of aldeheydes and ketones can be used for example formaldehyde, glyoxal or glutaraldehyde can be mixed with ketones or other aldehyde with the general formula $C_nH_{2n+1}$ CO $C_mH_{2m+1}$ where n=1 to 6 and m=0 to 6. The crosslinker can come from any combination of these compounds and the condensation reaction to form the crosslinker can occur on mixing with the polyamino compound or they can be prepared prior to the addition of the polyamino compound using any known acid, base or metal catalyst suitable for aldol condensation reactions.

Methylol Crosslinkers

This group of crosslinkers incorporate reactive methylol groups. They are obtained from the reaction of 2 or more molar equivalents of formaldehyde with one of the following: substituted phenol, melamine, urea, benzoguanamine, or glycouril. Such crosslinkers can be prepared and used as crosslinkers with the aid of acid or base catalysts, which is well known in this field. [Ref Henk van Dijk in "*The Chemistry and Application of Amino Crosslinking Agents or Aminoplasts*", John Wiley and Sons 1999 and T Brukhart, P. Oberressi and P. K. T. Oldring, "*The Chemistry and Application of Phenolic Resins or Phenoplasts,* John Wiley and Sons", 1998]. The methylol crosslinkers can be in monomer form, or a self condensed oligomer or polymer form. In a preferred embodiment of this invention the methylol crosslinker is added to a dilute solution of the polyamino compound (<5%).

Crosslinkers Containing at Least Two Oxirane Groups

Suitable crosslinkers belonging to this group are organic compounds containing at least two oxirane groups. These include compounds containing two and more oxirane groups and homopolymer or copolymer containing poly-oxirane groups. An organic fragment that can be an alkyl, aryl, substituted alkyl or substituted aryl can link the oxiranes.

Suitable compounds containing two or more oxirane groups are but not limited to bis7phenol A epoxy resin, di or poly glycidyl ether of diols or polyols, glycidyl ester of a polycarboxylic acid, di or polyglycidyl aliphatic or aromatic amines, or epoxy obtained from peroxidation of unsaturated compounds, homopolymer or copolymer of glycidyl(meth) acrylate. Specific examples consist of bisphenol A epoxy, butanediol diglycidyl ether, triglycidyl isocyanurate, 4,4'-methylenebis-(N,N-diglycidylaniline), glycerol propoxylate triglycidyl ether, diglycidyl 1,2-cyclohexanedicarboxylate, N,N'-diglycidyl-4-glycidyloxyaniline, poly(propylene glycol) diglycidyl ether, poly((phenyl glycidyl ether)-co-formaldehyde), poly(ethylene glycol) diglycidyl ether, 4-vinyl-1-cyclohexene diepoxide, diglycidyl resorcinol ether, 1,2,3,4-diepoxybutane, 1,2,7,8-diepoxyoctane, 1,3 diglycidyl glycerol ether, novalak epoxy resin, poly (dimethylsiloxane) diglycidyl ether terminated, poly [dimethylsiloxane-co-[2-(3,4-epoxycyclohexyl)ethyl] methyl-siloxane], polyglycidylmethacrylate, polyglycidylacrylate, poly(ethylene-co-methyl acrylate-co-glycidyl methacrylate), poly(ethylene-co-glycidyl methacrylate).

An appropriate accelerator or catalysts for the reaction between epoxy and amine can be added to the polyamine formulation. Suitable accelerators are Lewis acid or bases examples of which are but not limited to triethylenediamine (1,4-diazabicyclo[2.2.2]octane), triethanolamine, triethylamine, triethanolamine ethoxylate, tripropylamine, trifluoroboronmono-ethylamine (boron trifluororide-ethylamine complex), tertiary amine, pyridine, 2,4,6-tris (dimethylaminomethyl)phenol, benzyldimethylamine, piperidine, N-hydroxyethylpiperazine, N,N'-dimethylamino phenol, triphenyl phosphine and mixtures of two or more thereof. These catalysts can be used for any oxirane containing crosslinker used in this invention.

Crosslinkers Containing at Least One Oxirane and One Acrylate(methacrylate) Groups Suitable compounds that belong to this group are organic compounds that contain at least one oxirane and one acrylate (methacrylate) group. The acrylate and the oxirane groups can be linked by an organic fragment which can be an alkyl, aryl, substituted alkyl or substituted aryl. The compounds can contain multi or poly (meth)acrylate and oxirane groups. Compounds containing acrylate and oxirane group are more preferable as the chemical reactivity of acrylate with amine is higher than oxirane so polyamine containing oxirane groups can be formulated and further crosslinked on the oxidized polymer surface.

Such compounds are, for example, obtained by reacting epoxy compound such as those referred to above with one (meth)acrylic acid or by condensing compounds containing (meth)acrylate with hydroxyl or carboxylic groups with epihalohydrins. Specific examples are but not limited to glycidylacrylate, glycidyl methacrylate, epoxy acrylate of bisphenol A, 2-hydroxy-3-(4-oxiranylmethoxybutoxy)-propyl acrylate, 2-hydroxy-3-[4-[1-methyl]-1-(4-oxiranylmethoxyphenyl)-ethyl-phenoxy]propyl acrylate, aromatic epoxy polyacrylate such as EPON Resin 8021, 8101, 8111, 8121, and 8161 from Shell Chemical Company, Epoxyacrylate Ebecryl 3605(from UCB).

Crosslinkers Containing at Least Two Acrylate (methacrylate) Groups

Suitable crosslinkers of this group are organic compounds containing at least two (meth)acrylate groups. The (meth) acrylate group are linked by an organic fragment which can be an alkyl, aryl, substituted alkyl or substituted aryl. Compounds containing one acrylate and one or more meth-acrylate groups are preferable because the difference in the rate of reaction between acrylate and methacrylate with amines allows for a formulation with a long pot life. In a typical formulation initial reaction of the amine with acrylate is fast whilst the reaction with methacrylate is slower therefore making the final crosslinking step in solution slower.

Specific examples of these crosslinkers are but not limited to 2-(acryloxy)ethermethacrylate, ethoxylated bisphenol A di(meth)acrylate, polyethylene glycol di(meth)acrylate, 1,3-butylene glycol di(meth)acrylate, propoxylated neopentyl glycol di(meth)acrylate, alkoxylated aliphatic di(meth) acrylate ester, tris(2-hydroxyl ethyl)isocyanurate tri(meth) acrylate, pentaerythritol tri(meth)acrylate, glycerol propoxylate tri(meth)acrylate, pentaerythritol tetra(meth) acrylate, dipentaerythritol penta(meth)acrylate, di or tri (meth)acrylate methacrylate ester, di or tri (meth)acrylate acrylate ester, aliphatic urethane (meth)acrylate, aromatic urethane (meth)acrylate.

Crosslinker containing one or more halogens and one or more selected from the group oxirane, (meth)acrylate, aldehyde, isocyanate and anhydride.

Suitable crosslinkers of this group are organic compounds containing at least one or more halogens and one functional group selected from the groups oxirane, (meth)acrylate, aldehyde, isocyanate and anhydride. The halogen(s) and the other group are linked by an organic fragment which can be an alkyl, aryl, substituted alkyl or substituted aryl.

Examples of suitable compounds are but not limited to epichiorohydrin, epibromohydrin, epiiodohydrin, 2-bromoethyl acrylate, 3-bromopropyl acrylate, 4-bromobutyl acrylate, 6-bromohexyl acrylate, 7-bromoheptyl acrylate, 8-bromooctyl acrylate, 9-bromononyl acrylate, 11-bromoundecyl acrylate, 12-bromododecyl acrylate, 2-chloroethyl acrylate, 2-(2-chloroethoxy) ethyl acrylate, 2-[2-(2-chloroethoxy)ethoxy] ethyl acrylate, 4-chlorobutyl acrylate, 2-chlorocyclohexyl acrylate, 10-chlorodecyl acrylate, 6-chlorohexyl acrylate, 3-chloro-2,2-dimethylpropyl acrylate, 1-chloro-2-methyl-2-propyl acrylate, 8-chlorooctyl acrylate, 3-chloropropyl acrylate, 2-bromoethyl isocyanate, 2-chloroethyl isocyanate, 4-chlorobutyl isocyanate, trichloroacetyl isocyanate, 2-hydroxy-3-(2-chloroethoxy)propyl acrylate, 2-hydroxy-3-(4-chlorobutoxy)propyl acrylate.

For the halogen containing crosslinkers an inorganic acid, organic acid or a mixture of both can be added to the polyamine formulation to increase the pot life of the solution. Preferably an organic acid is added to the polyamine formulation so that the pH is less than 6, if the formulation is required to be stored for more than one day. Suitable acids include but are not limited to, hydrochloric acid, formic acid, acetic acid and oxalic acid.

Crosslinkers Containing One or More Halohydrin Group(s) and One Other Group Selected from Oxirane, (meth)acrylate Suitable crosslinkers of this group are organic compounds containing at least one or more halohydrin group(s) and one functional group selected from oxirane, (meth)acrylate, aldehyde. The halohydrin group(s) and the other group are linked by an organic fragment which can be an alkyl, aryl, substituted alkyl or substituted aryl. Suitable compounds are adducts of epihalohydrin with (meth)acrylate hydroxyl, (meth)acrylate acid compounds or adducts of epoxy compounds partially reacted with halogen hydride or epoxy acrylate compounds with halogen hydride. Examples are but not limited to 3-bromo-2-hydroxy propyl acrylate, 3-chloro-2-hydroxy propyl acrylate, 2-(3-chloro-2hydroxy)propoxy-ethyl acrylate, 2-(3-bromo-2-hydroxy)propoxy-ethyl acrylate, 3-(3-chloro-2-hydroxy)propoxy-propyl acrylate, 3-(3-bromo-2-hydroxy)propoxy-propyl acrylate, 4-(3-chloro-2-hydroxy)propoxy-butyl acrylate, 4-(3-bromo-2-hydroxy)propoxy-butyl acrylate,2-(3-chloro-2-hydroxypropoxycarbonyl)ethyl acrylate, 2-(3-bromo-2-hydroxypropoxycarbonyl)ethyl acrylate.

Crosslinkers Containing at Least Two Anhydride Groups

In yet another preferred embodiment the crosslinker can contain at least two anhydride functional groups. The anhydride groups can be linked by an alkyl, aryl, substituted alkyl or substituted aryl. The anhydrides can be discrete molecules such as but not limited to pyrromellitic dianhydride, 1,4,5,8-Naphthalenetetracarboxylic dianhydride, 3,4,9,10-perylenetetracarboxylic dianhydride. Anhydride crosslinkers can also be polymeric materials such as but not limited to maleic anhydride copolymers with ethylene, propylene or maleic anhydride grafted onto polymers. These polymers can be homopolymers or copolymers made from many types of monomer units including ethylene, propylene, isoprene, butadiene, methylacrylate, ethylacrylate methacrylate, butylacrylate.

The crosslinker is preferably present in solution at a concentration of less than 5%, preferably 0.001 to 5% and most preferably from 0.01 to 1 % by weight.

Solvents

Any suitable solvent or mixture of solvents can be used in the current invention and solvent should be chosen that is compatible with the surface modifying agent and crosslinker. A preferred solvent, particularly because of occupational safety and environmental considerations is water, particularly with PEI, although the solubility of the crosslinker should also be considered. Other suitable solvents may include alcohols such as ethanol, ketones, esters and hydrocarbons. The solvent will typically have a boiling point in the range of from 60 to 250° C. and more preferably 80 to 250° C.

Formation of Crosslinked Polyamine Layer on the Polymer Surface

There are two general methods for formation of the polyamino crosslinked surface/interface. The methods are:

A. Premixing the polyamino compound and crosslinker. The polyamino compound and the crosslinker are premixed under suitable conditions. Suppression of crosslinking before application to the oxidised substrate is essential. This can be achieved by preparing the polyamino crosslinking mixture as a dilute solution as is the case of using aldehyde crosslinkers such as glutaraldehyde with PEI. Another way to prevent unwanted crosslinking is to use a crosslinker that requires an external input to proceed, for example, a chemical initiator or catalyst such as water for silane based crosslinkers or a physical input, for example heat for maleated anhydride crosslinkers. Also crosslinking can be controlled by varying the reactivity of the functional groups for example by using a combination of relatively reactive acrylate functional groups with less reactive methacrylate or epoxide groups. The extent of crosslinking in solution can also be minimised by mixing the polyamino compound and crosslinker just prior to contact with the polymeric surface; and B. Step wise addition of the polyamino compound and the crosslinker. This method is particularly suitable for crosslinkers that rely on very reactive functional groups, such as acid chlorides or isocyanates. The polyamino compound can be applied to the surface first and the crosslinker applied afterwards.

The polyamino/crosslinking solutions can be applied by many standard methods which include but are in no way limited to spray coating, dipping, roll coating, meniscus coating, spin coating, gravure coating etc. Once the solution is applied the solvent can be evaporated off either under ambient conditions or at elevated temperatures using an oven, infrared radiation or any other common method. On the other hand excess solution can be removed by washing with clean water or another solvent or blown off using a high pressure gas such as compressed air. The time taken between the contact of the grafting solution with the polymeric substrate and drying is from 0.001 seconds to 4 hours. When dip coating is used an external physical field such as ultrasonication can be applied during dipping to enhance the grafting of polyamino compounds. After the polyamino compound is adsorbed on the surface a suitable physical fields such as heat, IR, microwave, etc can be used to enhance or initiate the crosslinking reaction of the polyamino compounds.

The polyamine and crosslinking agent are preferably applied to the substrate surface at a rate of less than 2 g of the total of polyamine and crosslinker per square meter of surface area. Generally the thickness of the crosslinked network will be less than 3 microns.

Functional Crosslinked Interfaces and the Adhesion of Coatings

This invention allows for the preparation of a predefined multifunctional interface/interphase which can be designed to optimise specific interactions with various functional coatings or molecules. These coatings can have a thickness in the order of a molecular monolayer to a few millimeters and in a preferred embodiment of this invention the functional coatings are applied after the polyamino crosslinked interphase has been grafted to the surface of the polymer substrate. The coatings may impart on the substrate many different properties which include but are not limited to the following:

- improved permeability characteristics towards gases, odours or vapours
- conductivity either electrical or ionic
- magnetic properties
- biocompatability
- controlling surface wettability
- improved surface hardness
- slip enhancement or slip reduction
- absorption or reflection of UV-vis, IR, MW or RF
- photovoltaic properties
- electroluminesence
- chemical catalytic properties
- linear or nonlinear optical properties The coatings may also have a decorative and/or informative function such as paint, varnishes, lacquers and printing inks. The coating can also be an adhesive for the joining of the treated polymer substrate to another material. I For those experienced in the art, knowledge of the components of a coating can be used to determine what type of polyamino/crosslinker will provide optimal interactions. For example it is well known that polyvinyl alcohol (PVOH) can be used as barrier coatings for plastic films. A major factor that governs the successful use of PVOH is its adhesion to substrates with particular difficulties arising from coating on inert polymer substrates such as polyethylene or polypropylene. It is also well known that aldehydes bond to polyvinyl alcohols, thus a polyamino network crosslinked with glutaraldehyde will provide free aldehyde groups which will lead to bond formation with PVOH based coatings.

Another advantage of this invention is that grafted polyamino compounds crosslinked with silanes will form strong bonds with silanes present in coating, adhesive or sealant formulations a situation which is common in many commercial formulations today. Another common component in many commercial formulations is melamine, urea, benzoguanamine, or glycouril, thus an aldehyde containing crosslinker would be compatible with such formulations.

Another important application area is improving the interaction between polymer substrates and metallic coatings such as aluminium, copper, platinum, silver, gold etc. With this invention improved adhesion at the polymer metallic coating interface is obtainable using a variety of polyamino crosslinked formulations where strong interactions are expected between the amino groups and the metallic coatings. The interactions between the crosslinked polyamino surface and metal coatings such as copper, platinum, silver or gold, could be further improved if sulfur compounds were present in the crosslinked structure, which could be easily achieved using a polyamino system crosslinked with a silane and a silane co-crosslinker that contains sulfur groups, such as mercaptopropyl trimethoxysilane or bis[(triethoxysilyl) propyl] tetrasulfane.

Also the adhesion of inorganic oxides or inorganic salts on polymer films can be enhanced by this invention if the crosslinkers contained for example silanes or beta-diketones, a well known metal binding group which would be present if methyl pyruvate was used as a crosslinker.

In another embodiment, this invention provides a very useful and cost effective method to engineer on a polymeric material a crosslinked surface containing highly reactive functional groups for multi step surface coupling of molecules possessing specific physico-chemical properties. Groups available include amine group from the polyamine and other functionalities from the crosslinkers and co-crosslinkers. Suitable compounds for multi step surface coupling are molecules containing reactive groups selected from acidic group (carboxylic, sulfonic, phosphoric/phosphonic), (meth)acrylate, epoxy, aldehyde, hodroxyl, thio, isocyanate, isothiocyanate, anhydride, halide. These compounds can be small molecules with 2 to 60 carbon atoms, or macromolecules with molecular weight ranged from a few hundreds to a few millions. They can also be inorganic species such as metal salts, oxides or chelate complexes.

The process for this multi step surface grafting is:

A) providing polymer surface with functionalities by suitable oxidation method

B) contacting the polymer surface with a polyamine formulation

C) contacting molecules of interest with the polymer surface

Highly water wettable surface on polymer substrate can be made by contacting the surface during "step C" with solution containing ionic and no ionic water soluble macromolecules. Macromolecules of interest include polysacharides, homopolymer or copolymers made from acrylic acid, vinylsulfonic acid or 4-styrenesulfonic acid, polymetaphosphoric acid, polyvinyl alcohol, or amino-acids. Preferably the macromolecules should contain acrylate or aldehyde and carboxylic groups such as modified dextran, polyacrylic acid, modified polyvinyl alcohol, poly (acrylic acid-co-acrylamide). Catalyst for activation of acid group such as carbodiimide, N-hydroxy-succimidyl can be used to improve the chemical coupling of acidic containing molecules.

Antifouling and/or antibacterial surface can be made by contacting the surface during "step C" with solution containing polyethylene glycol, polypropylene glycol, peptides, lysozyme. Preferable compounds are polyethylene glycol mono or diacrylate, polyethylene glycol mono or diglycidyl, are polyethylene glycol mono or dialdehyde.

The bio-activity/bio-compatibility of polymer can be improved by contacting the polymer surface "during step C" with bio-active/bio-compatible molecules. It is well known that polyglutaraldehyde can covalently bind amino groups thus a polyamino/glutaraldehyde crosslinked system containing excess glutaraldehyde would be an excellent surface for binding bioactive molecules such as peptides, proteins or enzymes.

UV/IR inhibitor, absorbers, or fluorescent compounds can be grafted onto the surface during "step C" to provide an effective method to reduce UV or laser damage of the substrate.

The device, according to the current invention comprises one or more components selected from the group of:

(a) surface modification device comprising one or more of the following: surface activation and graft chemical/functional chemical delivery means such as, but not limited to, a surface oxidation device and graft chemical/functional chemical delivery device, the said means comprising one or both of these devices and/or their multiplicity;

(b) means for providing relative motion of the surface of the object to be modified with respect to a surface modification device as described in (a) above, or alternatively by the means for providing relative motion of the surface modifying device as described in (a) above in relation to the surface of the object to be modified in accordance to this invention;

(c) means for application of and/or contacting graft chemicals and/or functional chemicals to and/or with the surface to be modified optionally further including means for generation of a suitable form of said graft chemicals wherein the means for generation of a suitable form may include gas and/or steam and/or liquid—liquid and/or gas-liquid and/or liquid-solid and/or gas-solid and/or any other known form of chemical or mechanical dispersion, suspension, vapour and/or aerosol or a mixture of any of these, provided and/or admitted from an external source or created by a suitable generator;

(d) static and/or dynamic physical field and or pulse generator; and (e) means for post processing, eg. chemical application and/or finishing, processing, drying and/or other device.

The preferred apparatus includes at least one said means for providing relative motion, said surface modification device comprising any activation means and said means for delivery or application of graft chemicals and/or other functional chemicals or materials and/or other processing means as described in (a) to (e) above. The graft chemicals to be applied by the apparatus may be mono and/or poly functional chemicals such a those disclosed in the above-mentioned US patents.

The said surface modification devices such as described in (a) above and in particular the surface activation means and/or graft chemical/functional chemical admission/delivery means are provided, in accordance with this invention, by a single or multiple device capable of providing of either or all: static, continuous or dynamic/pulsating mode of delivery of surface activation means for instance surface oxidation such as but not limited to corona discharge, plasma, glowing arc, flame and/or other forms of ionisation, combustion, UV, laser. The examples of gliding arc are embodied in the form but not limited to corona jet devices such as those manufactured by Arcotec, Ahlbrandt, Tantec, Arcojet, Lectro Engineering and others.

Pulsating flame and pulsating combustion devices are such, as described in but not limited to our earlier inventions embodied in Australian Patent Applications PQ 8097 and PN 3698, and including further improvements of these as described in the current invention.

Corona discharge, UV devices, electron beam sources and lasers are known to those skilled in the art of surface modification from ample literature.

The above components of the device according to this invention are preferably arranged in a configuration and the sequence that enables the following functions to be performed in accordance with the preferred embodiment of the invention in FIG. 1, FIG. 2 and FIG. 3, which are shown here as illustrative examples only In the drawings.

The relative motion (1) device enables the surface of the object (0) to be exposed to the action of the surface modification device (2). The relative motion can be provided in a number of ways.

In one embodiment of the current invention the object (0) is placed on the relative motion device (1) such as a conveyor for transporting the object by (mechanical, electrical, magnetic, pneumatic or other means etc) and carried through an active medium of the surface modification device (2). The surface modification device, and in particular its surface oxidation device and/or medium will generally produce oxidation and/or other types of the surface by suitable means such as electrical discharge, flame, plasma, ozone, UV radiation, laser, electron beam or other suitable means for combination thereof.

The surface modification and/or oxidation device or medium can operate in either or both modes such as static or dynamic/pulsating mode. The examples of such static means include but are not limited to the following: ozone, flame, heat energy in the presence and/or excess of oxygenating or halogenating materials, UV radiation, plasma.

The examples of relevant dynamic/pulsating means include but are not limited to the following: corona discharge, gliding arc, pulsating combustion devices, UV radiation provided through a pulse excimer laser, pulsating plasmas, electron beam.

Figure 1:
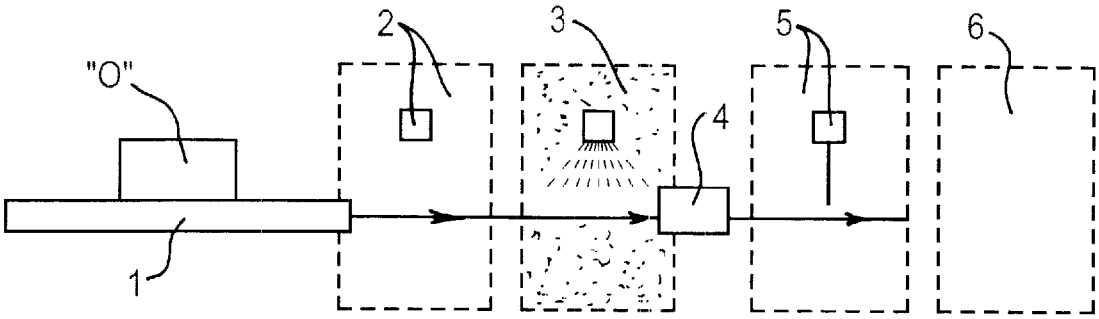
FIG. 1 is a schematic drawing showing one particular example of the apparatus of the invention.
Figure 2:
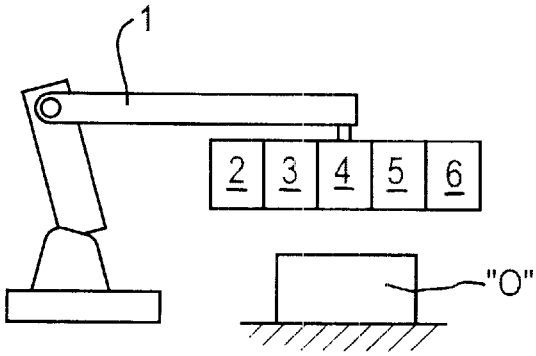
FIG. 2 and 3 is a schematic drawing showing other embodiments of the invention.
Figure 3:
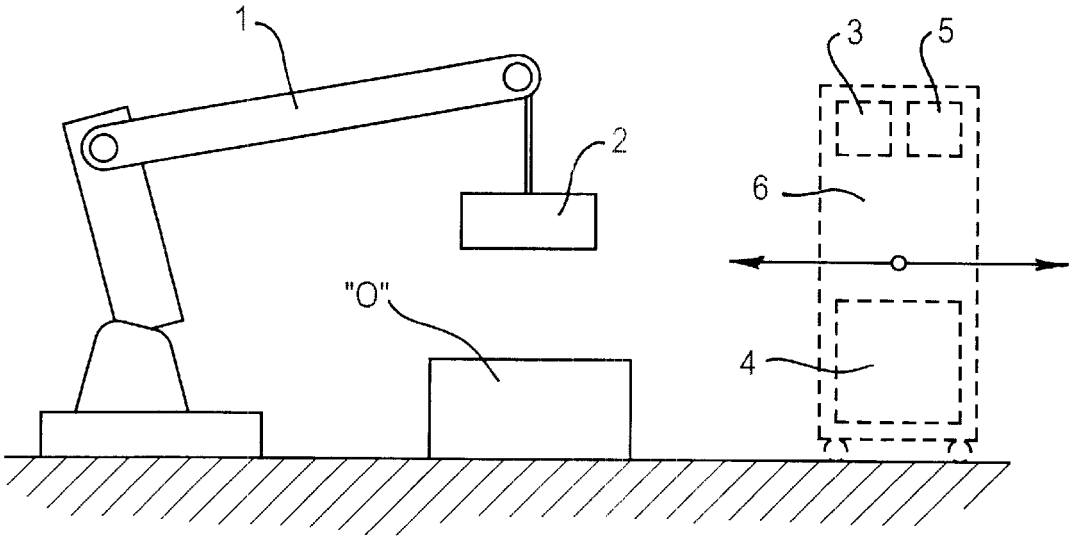

In another embodiment of the current invention the stationary or moving object "O" passes through the active medium of the surface modification and/or oxidation device which is moving along and/or across the treated surface by suitable means such as a robotic arm as shown in FIG. 2 and 3.

During this motion, and surface modification process,as explained above, the surface of the stationary or moving object (0) is exposed to the graft chemical(s) and/or functional chemical(s) delivered by an appropriate delivery system and/or generator and/or applicator (3). Graft chemical(s) and/or functional chemicals, the examples of which are, but not limited to the following: adhesion promoting chemicals, electroconductive and/or charge conducting or storing chemicals, metallic coatings, bio-functional chemicals and materials crosslinking agents, barrier coatings and relevant chemicals, energy (eg: UV, IR, RF) absorbing chemicals or coatings, hardness or slip properties controlling materials and other are brought into contact with the surface by suitable means. Examples of suitable means for delivery and contacting the surface of the object with graft chemicals and/or functional chemicals and materials may be selected from the group consisting of spray deposition, cold or hot vapour, aerosol, vacuum assisted deposition, immersion, brush on and/or any other means of delivery known to exist for delivering gases, vapours, liquids, solids and dispersions.

In a preferred embodiment the said surface modifying chemicals and materials are delivered, and/or applied within the oxidation and/or other type of surface activation zone created by any or all devices and/or means available in any particular embodiment of this invention.

Any of the above can be provided in the presence of vacuum or elevated pressure within the range of $10^{-8}$ Torr up to 200 bar, preferably at ambient pressure and/or elevated pressure.

The graft chemical and/or functional chemical or material may be contacted with the substrate/object surface at the temperature ranging from 0° to 5,000° C., and preferably at the temperature ranging within room temperature up to 2500 degrees C. The above application of the graft chemicals and/or functional chemicals and materials can be implemented in a separate graft chemical deposition device or preferably in a combination with the surface activation medium and/or device. For example in one embodiment the graft chemical is applied within the corona discharge, flame treatment, UV treatment, ozone treatment and/or other treatment zone of the surface activation device.

The surface modified object "O" and/or graft chemical/functional chemical or other materials used in surface modification according to this invention as well as any part or the entirety of the oxidizing/activating zone and relevant devices and those comprising any part or the entirety of devices used for the delivery and processing of fluids, gases or solids used in the process of surface modification, including ionization and/or combustion processes within and/or outside of any component of the apparatus of this invention may be exposed to the static or dynamic physical field created by an appropriate generator (4) at any stage of processing within or outside of the apparatus according to the current invention. The generation means may generate one or more forms of energy and are generally selected from the group consisting of static and/or dynamic magnetic, Electro-magnetic field, ultrasonic radiation, microwave radiation, radio frequency radiation, infra-red radiation, ultra violet radiation, visible light radiation, electron beam radiation, heat energy, and controlled pressure within the range from vacuum up to 200 bar, and preferably within the room pressure up to 20 bar—whatever the means of generation and delivery.

The current invention includes subjecting the said object (0) to a static and/or dynamic fluid exposure including any fluid and/or gas and/or their mixtures alone and/or in combination with the graft chemicals and/or other functional chemicals and materials in their original or converted form including vapours, sprays, combustion products, ionised products, at any part within or outside of the surface modifying device including those involved in the fluid, gas, vapour, mixture or other material's dispensing, processing, conversion or combustion and/or application device. The examples of these are but not limited to as follows:

individual gases and/or their mixtures such as may be selected from air, oxygen, hydrogen, nitrogen, halogenating gases or liquids and their vapours, and/or ionizable gases such as argon helium, xenon, crypton and mixtures, combustible fluids including gases and/or their mixtures with air and/or oxygen and/or hydrogen at an appropriate mixture composition enabling the combustion or conversion to other type of energy preferably with excess oxygen residue in the flame tip or in the post-combustion product, of two of more thereof; and mixtures of one or more of the above gases with graft chemicals and/or other functional chemicals and materials such as but not limited to: adhesion promoting chemicals, electroconductivity providing chemicals and materials, charge conducting or retaining chemicals, biofunctional chemicals, energy-absorbing molecules and chemicals, barrier materials, wettability controlling chemicals, and others.

Any of the above can be delivered at ambient or elevated temperature and pressure ranging from $10^{-6}$ bar up to 200 bar preferably ranging from ambient pressure up to 20 bar. When elevated temperature is used it can range from 10 to 5000° C. preferably 40 to 2500° C.

The 2 or 3 dimensional objects can be but are not limited to, in the form of shaped items, thin film, sheet, fibers, flakes, granulate or other optional physical form.

The most preferred embodiment of surface modification apparatus according to this invention comprises the following:

1. oxidating or surface activating device, preferably in the form of the following:
   (a) a single or multiple combustion device such as but not limited to:

linear or curvilinear flame burner, including a burner providing a circular flame wherein the flame is in the form of a single or multiple lines or individual flame jets forming single or multiple lines or covering the entire area of the burner outlet. The combustion devices such as flame burners may be in the following form:

(i) Those producing a steady flame as a result of combustion of combustible/flammable gas/air mixture admitted to the burner at predominantly constant pressure to any part of the burner; and (ii) Those producing dynamic/pulsating flame as a result of the use of a pulsed combustion device such as that described in detail by our earlier invention disclosed in the Australian Patent Application PQ 8097 and PN 3698/95.

The invention will now be described with reference to the following examples. It is to be understood that the examples are provided by way of illustration of the invention and that they are in no way limiting to the scope of the invention.

EXAMPLE 1

This comparative example demonstrates significant advantages of the method of current invention implemented by the apparatus according to this invention in comparison with other methods of surface modification of polymers for enhancing the adhesion of automotive paints.

The following materials were used in this examples:

(i) substrate: Corton PDR 1054/2 HS UV3 (No. 7407) made by Polypacific/Montell Australia (ii) paint: PPG Dulux Heron White basecoat and clearcoat All substrates were surface-treated prior to painting, as detailed in Table 1. Subsequently, all substrates were painted, using industrial robot to achieve paint coat thicknesses as required by paint and automotive manufacturers and baked in accordance with PPG/Dulux specification. Paint adhesion was determined in any condition and subsequent to immersion of painted specimens in water for 240 hours at 35° C. The procedure for determining paint adhesion was that described in detail in ASTM-D4541-89. The quality of paint adhesion was determined by pull-off strength [MPa], and cohesive failure of substrate [% CF].

Figure 4A:
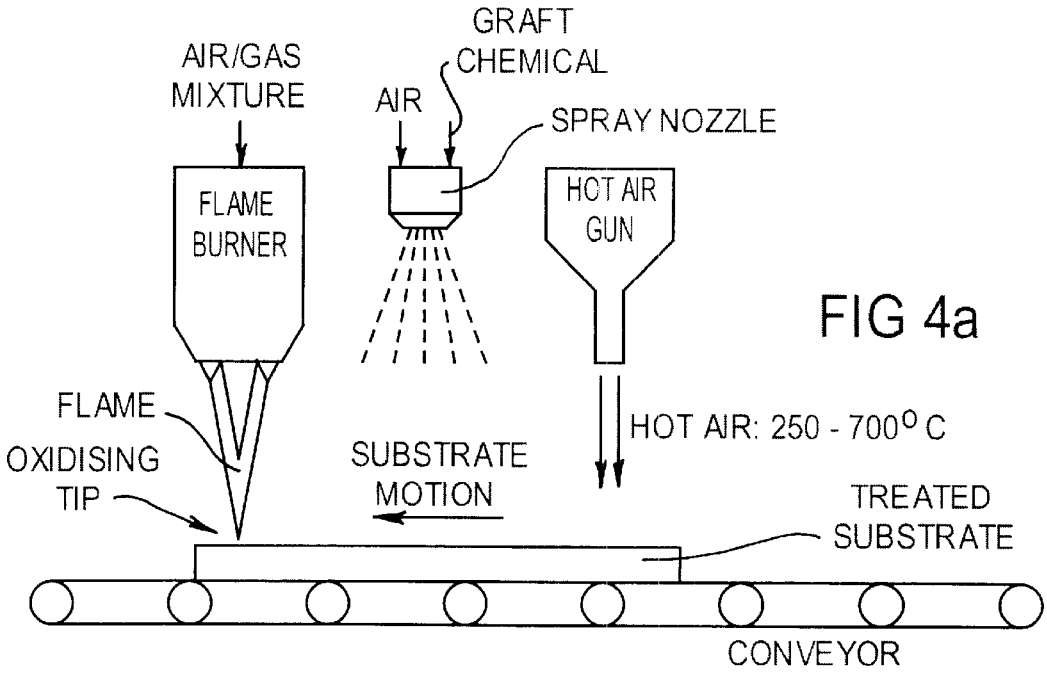
FIGS. 4 and 5 illustrate the examples of an embodiment of a surface modification and/or surface oxidation device operating in one or both modes: static and/or dynamic oxidation through a static and/or dynamic/pulsating combustion device and/or static and/or dynamic/pulsating application of graft/functional chemicals.

The details of substrate treatments as added in Table 1, were as follows:

1. Flame treatment only: 360 L/min of air/gas mixture (substrate speed: 60 m/min with oxygen excess of 1%;
2. As 1+hyperprime (2% solids CPO) industrial primer;
3. As 1+0.25% PEI in water (Lupasol G35);
   Stages: (i) PEI solution sprayed onto flame-treated substrate subsequently to flame treatment;
   (ii) no drying;
4. As 3 with during at 90° C. for 20 minutes.
5. Treatment with the use of equipment as illustrated in FIG. 4(*a*):
   substrate motion speed: 60 m/min
   flame conditions: 360 I/min: air/gas mix flow rate $O_2$ excess: 1.0% burner-substrate distance: 20 mm graft chemical: PEI (0.25% G35 in water):spray hot air gun:air temperature

| | |
|---|---|
| 5.1 | 250° C. |
| 5.2 | 300° C. |
| 5.3 | 500° C. |
| 5.4 | 650° C. |

Figure 4B:
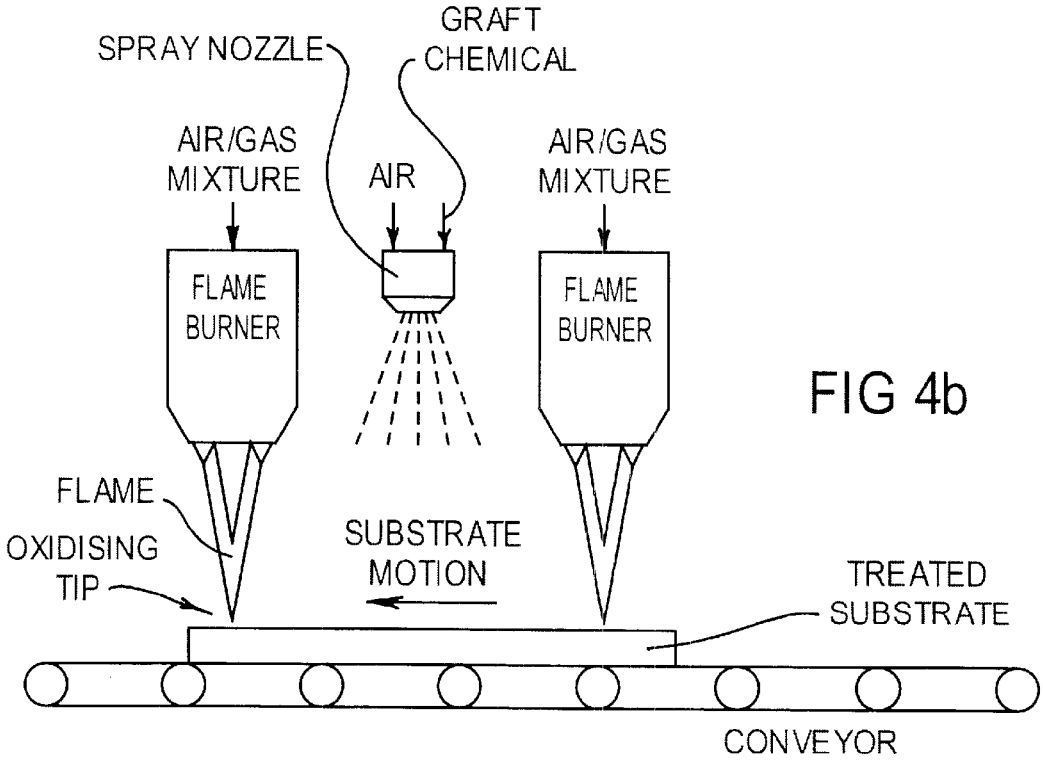
Figure 5A:
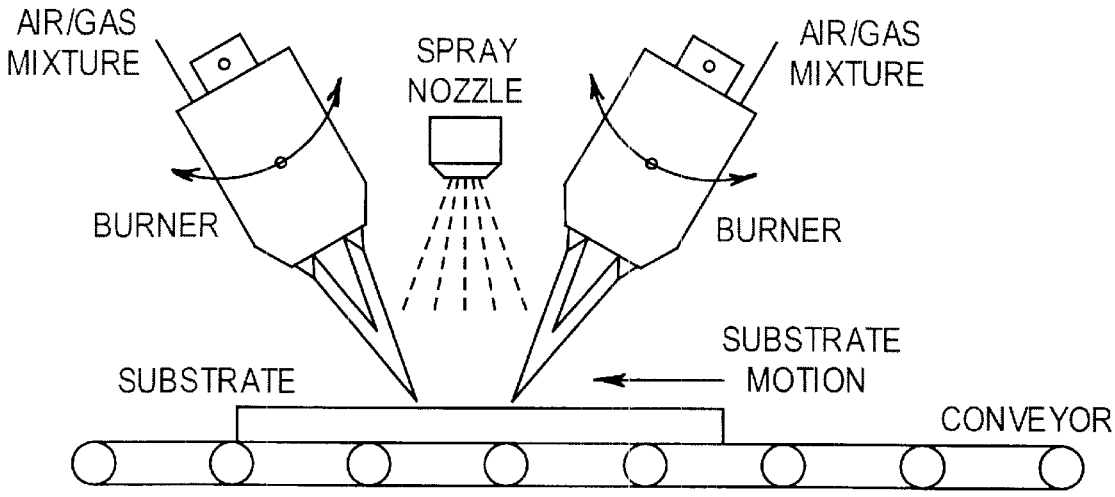
Figure 5B:
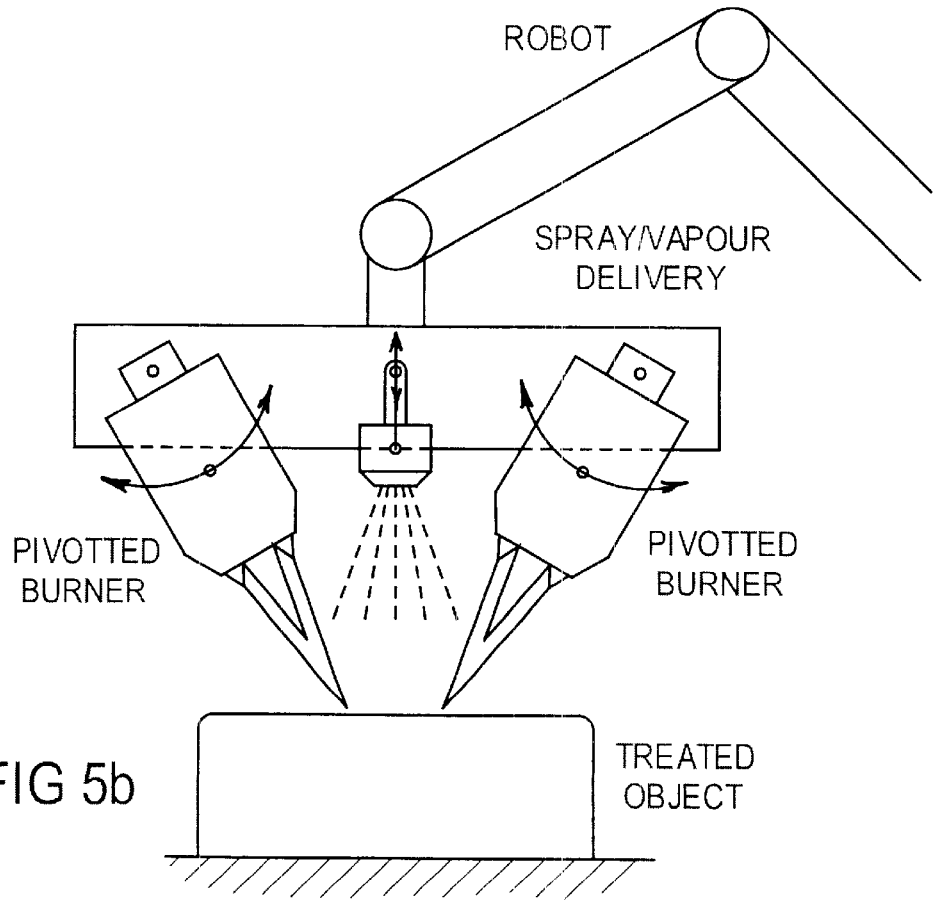

6. Treatment with the use of equipment as illustrated in FIG. 4*b:* substrate motion speed: 40 m/min graft chemical: PEI (0.25% G35 in water): delivery by spray between burners.

The following is observed from the results listed in Table 1, in which the example 2A and 2B represents current industrial technology:

Flame oxidation above (example 1) results in unsatisfactory paint adhesion;

Flame oxidation and grafting of a polyfunctional amine-containing compound without drying (Example 3) as in our U.S. Pat. No. 5,922,166 improves adhesion in comparison with flame oxidation alone;

(iii) Surface modification of the substrate in accordance with our U.S. Pat. No. 5,922,166 in the embodiment involving elevated temperature through oven drying (90° C. for 20 minutes) [example 4] results in further improvement of paint adhesion quality over examples (1) and (3);

(iv) Surface modification as in (iii) above involving the exposure of graft chemical during and after contacting the said chemical with the oxidized substrate, and exposing it to the heat energy embodied in hot air at the range of 250 to 650° C results in further improvement of quality of adhesion Flame treatment conditions:

air/gas mixture flow rate: 220 I/min treatment (substrate) speed: 40 m/min flame burner-substrate distance: 40 mm NOTE: both burners were operating under identical conditions The results on paint adhesion quality for all treatments, as above, are listed in Table 1:

TABLE 1

Paint quality adhesion 240 hours immersion in water. Strength in [Mpa]; substrate cohesive failure in [% CF]

| Treatment | EPALEX 7095 (Bumper Facier Material) | | CORTON PDR 1054 (BSPM Material) | |
|---|---|---|---|---|
| No. | Mpa | % CF | Mpa | % CF |
| 1 | 2.7 | 63 | 3.45 | 18 |
| 2 | 2.8 | 100 | 4.80 | 96 |
| 3 | 2.6 | 100 | 4.00 | 20 |
| 4 | 3.1 | 100 | 4.90 | 80 |
| 5.1 | 2.5 | 100 | 5.00 | 83 |
| 52. | 2.5 | 100 | | |
| 5.3 | 2.5 | 100 | | |
| 5.4 | 2.5 | 100 | | |
| 6* | 3.1 | 100 | 5.1 | 90 |

Note:

6* PEI: PS@ 0.25% in $H_2O$: substrate immersion for 240 hours at 35° C.

(v) Surface modification in accordance with the current invention, as represented by an embodiment illustrated in FIG. (4*b*) and results in Table 1 relevant to process No. 6 results in significant improvement of quality of point adhesion which is demonstrated here to match or exceed that offered by industrial technologies involving the use of solvent-based primer comprising chlorinated polypropylene and toluene to xylene as solvents (see 6* vs 2 in Table 1).

EXAMPLE 2

In this example, the substrates as in Example 1 are treated with the use of the apparatus and the method of this invention. The graft chemical in the form of spray is contacted with the flame and the products of combustion process. The heat energy embodied in the flame and the post-combustion evaporizes the spray droplets and the graft chemical, whilst the kinetic energy of these gases and post-combustion products facilitates the delivery and the contact of the graft chemical vapour with the surface of the oxidized and surface modified substrate.

The treatment condition are as follows:

(i) flame treatment (both burners)

air/gas flow rate: 220 I/minute oxygen excess: 0.4% treatment speed: 60 m/min burner-substrate distance: 40 mm (ii) graft chemical:

PEI (G35/BASF): 0.2% in water (iii) burner angle:

(a) vertical vs substrate (b) 30> vs vertical direction.

The results regarding the quality of paint adhesion (PPG/Dulux: Heron White) are listed in Table 2.

TABLE 2

Paint Adhesion quality after 240 hours immersion in 35° water for the treatment embodiment as in FIG. (5b)

| Burner Angle [°] | EPALEX 7095 | | CORTON PDR 1054 | |
|---|---|---|---|---|
| vs vertical. | Mpa | % CF | Mpa | % CF |
| 0° | 3.1 | 100 | 5.1 | 90 |
| 30° | 3.1 | 100 | 5.2 | 100 |

EXAMPLE 3

Figure 6:
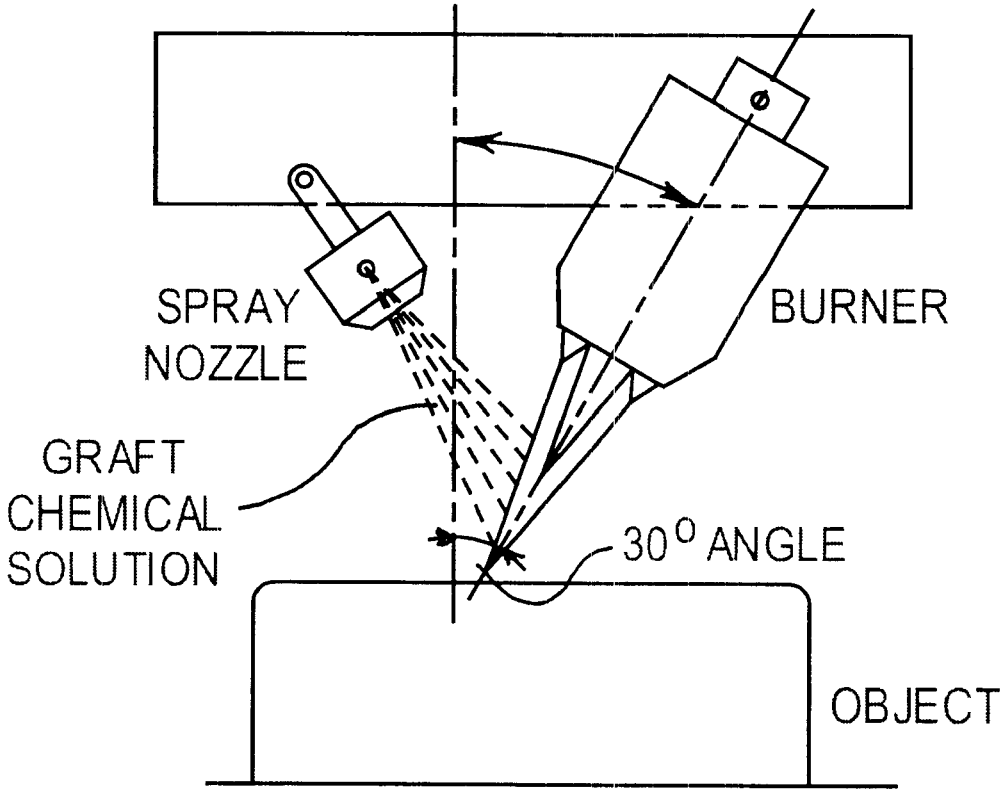
FIGS. 6 and 7 are schematic drawings representing another embodiment of a device for surface modification according to our invention involving dynamic/pulsating combustion device and static/dynamic graft chemicals/functional chemicals application system as well as an alternative means for post-processing/finishing of said chemicals.
Figure 7:
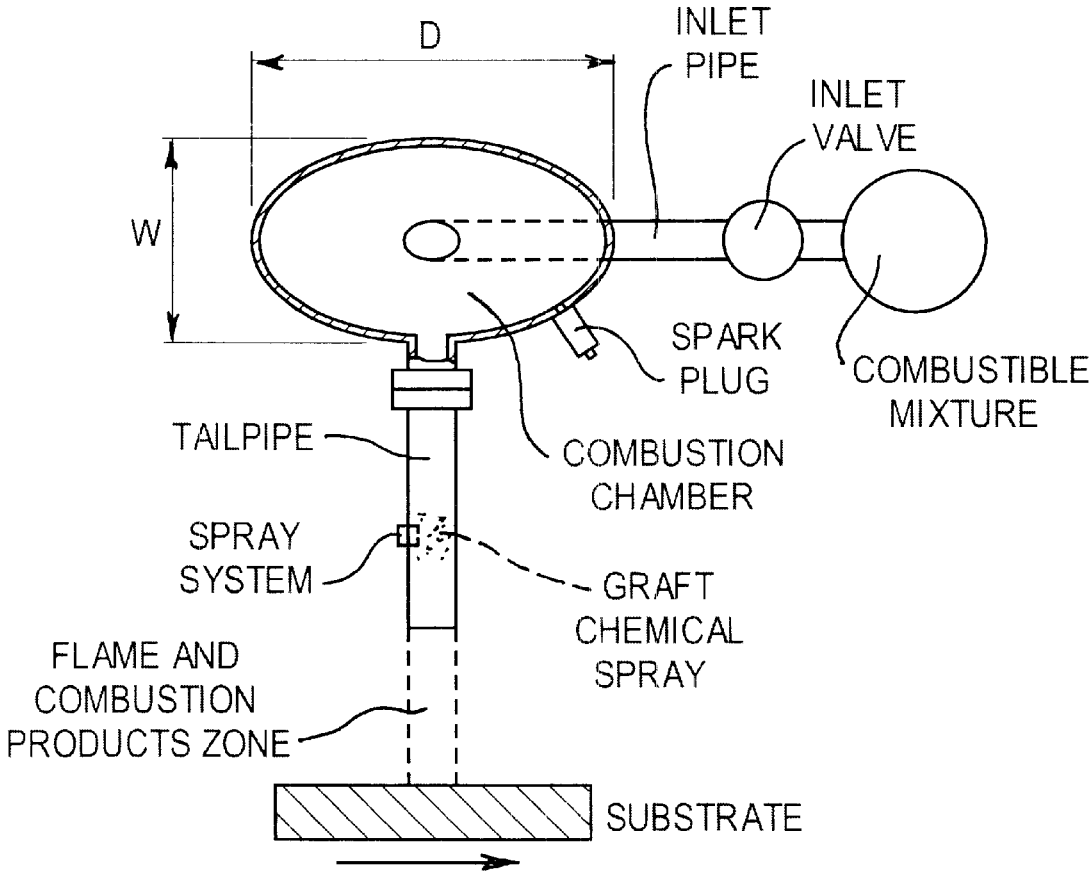

In this example as a single burner is used as illustrated in FIG. 6. The burner angle is 30° vs vertical direction. The same graft chemical and other treatment conditions are in Example 2 are used. The results of paint adhesion quality are listed in Table 3.

TABLE 3

Paint adhesion quality (after 240 hours immersion in 35° water) for treatment according to embodiment in FIG. 6.

| Burner | EPALEX 7095 | | CORTON PDR 1054 | |
|---|---|---|---|---|
| Angle [°] | Mpa | % CF | Mpa | % CF |
| 0°* | 3.1 | 100 | 5.1 | 90 |
| 30° | 3.0 | 100 | 5.0 | 100 |

*Example from Table 2

EXAMPLE 4

In this example the graft chemical (0.1% G35 as in Examples 2 and 3) has been sprayed into the tailpipe of the pulse combustion burner in accordance to our invention PQ 8097).

The substrate was moved in relation to the flame at the speed of 60 m/minute. The flame combustion were as follows: Flow rate: 50 I/min; oxygen excess: 0.4%. Tailpipe substrate distance: 40 mm.

The results regarding paint adhesion quality were the same as in Table 3 for the standard Aerogen Burner titled at 30°.

What is claimed is:

1. A process for modifying the surface of a substrate containing a polymeric material by contacting the surface with a modifying agent to bond the modifying agent to the surface, the process comprising:

providing a modifying agent composition comprising a modifying agent;

providing surface modification means comprising a burner for forming a zone of elevated temperature adjacent to a part of the surface of the substrate and an applicator for applying the modifying agent composition into the zone of elevated temperature;

applying the modifying agent composition into the zone of elevated temperature to vaporise the modifying agent and provide diffuse contact between the modifying agent and the part of the surface of the substrate; and providing relative movement of the surface modification means with respect to the surface of the substrate and wherein the surface modifying agent comprises a polyamine containing at least four amine groups including two amine groups selected from primary and secondary amine groups.

2. A process according to claim 1 wherein the modifying agent composition is heated to a temperature sufficient to produce vaporization of the composition and less than the decomposition temperature of the modifying agent.

3. A process according to claim 1 wherein the heating zone provides a temperature of at least 120° C.

4. A process according to claim 1 wherein the heating zone is provided by a portion of the burner selected from the group consisting of a burner flame, a burner combustion chamber, a burner combustion product stream, and combinations thereof.

5. A process according to claim 4 wherein the products of combustion of the burner are directed onto the surface of the substrate.

6. A process according to claim 1 wherein the surface modification means provides a plurality of flame zones.

7. A process according to claim 4 wherein the burner comprises a combustion chamber which provides pulsed combustion.

8. A process according to claim 4 wherein the burner comprises a combustion chamber and said burner further comprises an inlet for an oxidizing atmosphere such as air, a combustible gas inlet for feeding combustible gas under pressure, ignition means and valve means for controlling the flow of oxidizing atmosphere and combustible gas into the chamber.

9. A process according to claim 1 wherein the surface of the substrate is oxidized to provide functional groups and wherein the modifying agent is reactive with said functional groups.

10. A process according to claim 9 further comprising an additional step in which the substrate is oxidized by oxidation means selected from the group consisting of corona discharge, plasma treatment, chemical oxidation, and UV treatment prior to applying the modifying agent composition.

11. A process according to claim 1 further comprising treating the substrate with a physical field selected from the group consisting of an ultrasonic field, a microwave field, a radio-frequency field, beat in the range of from 50 to 150° C. and combinations of two or more thereof.

12. A process according to claim 1 wherein the polyamine is selected from the group consisting of polyamine polymers of molecular weight in the range of from 200 to 2000000 and non-polymeric ainines containing from 6 to 30 carbon atoms.

13. A process according to claim 1 wherein the polyamine is a polyethylenimine, polyvinylamine or polyallylamine of molecular weight of from 400 to 750000.

14. A process according to claim 1 wherein the substrate is a cellulosic material derived from perennial plants.

15. A process according to claim 14 wherein the cellulosic material is selected from the group consisting of hardwood, softwood, cotton, jute, flax, hemp, ramie, sisal, coir, viscose, softwood kraft and composites containing cellulose fibre.

16. A process according to claim 1 wherein the modifying agent composition further comprises a solvent and the concentration of the surface modifying agent in the solvent is in the range of from 0.00001 to 50% by weight.

17. A process according to claim 16 wherein the concentration of the modifying agent is in the range of from 0.01 to 5% by weight.

18. A process according to claim 1 wherein the modifying agent composition is a solution in a solvent selected from the group consisting of aqueous solvents, alcohols and mixtures thereof.

19. A process according claim 1 wherein the modifying agent composition further comprises a cross-linking agent reactive with the polyamine to provide a cross-linked network grafted to the surface of the substrate.

20. A process according to claim 19 wherein the crosslinking agent has at least two functional groups including a first functional group reactive with an amino functional group of the polyamine and a second functional group reactive with a functional group present in the polyamine or crosslinking agent.

21. A process according to claim 19 wherein the crosslinking agent is selected from the group consisting of organofunctional silanes having an organic functional group for reaction with an amine and a silane group adapted to condense with other silane groups in the presence of water to form Si—O—Si bonds; methylol crosslinkers; crosslinkers containing at least two oxirane groups; compounds containing at least one oxirane group and at least one acrylate or methacrylate group; compounds containing at least two groups independently selected from acrylate, methacrylate, methacrylamide and acrylamide; compounds containing one or more halogen groups and one or more groups selected from the group consisting of oxirane, methacrylate, acrylate, aldehyde, ketone, isocyanate and anhydride; compounds containing halohydrin and another functional group selected from the group consisting of oxirane, acrylate and methacrylate; and compounds containing at least two anhydride groups.

22. A process according to 19 wherein the crosslinking agent is a silane of formula:

$$X\ Si\ R^1(R^2)_2$$

wherein

X is any organic fragment of from 3 to 60 carbon atoms containing at least one group selected from the group consisting of oxirane, anhydride, acid chloride, chloroformate, sulfonyl chloride, ketone, aldehyde, carboxyl, isocyanate, acrylate, methacrylate, acrylamide and alkyl halide;

$R^1$ is a group susceptible to hydrolysis; and $R^2$ are independently selected from groups susceptible to hydrolysis and from the group consisting of alkyl, aryl, vinyl, substituted alkyl, substituted aryl and substituted vinyl.

23. A process according to claim 22 wherein the silane is of formula $$Y—R^4Si\ R^2(R^3)_2$$

wherein $R^4$ is a group of formula $C_nH_{2n}$ wherein n is from 0 to 12 or a benzyl group of formula $CH_2C_6H_4$;

Y is selected from the group consisting of methacryloxy, acryloxy, acetoxy, halogen, carbomethoxy, 4-chlorosulfonylphenyl, isocyanate, chloroformate, carbochloride, 3,4-epoxycyclohexyl and ureido;

$R^2$ is selected from the group consisting of chloro, $C_1$ to $C_{12}$ alkoxy and carboxylate of formula $O_2CC_nH_{2n+1}$ wherein n is an integer from 1 to 11; and Y is selected from the group consisting of chloro, $C_1$ to $C_{12}$ alkoxy, phenyl, cyclohexyl, cyclopentyl, $C_1$ to $C_{12}$ alkyl, and carboxylate of formula $O_2CC_nH_{2n-1}$ wherein n is an integer from 1 to 11.

24. A process according to claim 19 wherein the crosslinking agent is selected from the group consisting of:

aldol condensation products selected from the group consisting of glutaraldehyde, methyl pyruvate, ethylpyruvate, pyruvic aldehyde, methyl levunate, ethyl levunate and mixtures of at least one of formaldehyde, glyoxal and glutaraldehyde with one or more ketone of formula $C_nH_{2n+1}CO\ C_mH_{2m+1}$ wherein n and m are independently selected from 0 to 6;

methylol crosslinkers provided by reaction of two or more molar equivalents of formaldehyde with at least one compound selected from the group consisting of phenol or substituted phenol, melamine, urea, benzoguanamine and glucouril;

oxiranes selected from the group consisting of bisphenol A epoxy resins; di and poly glycidyl ethers of diols and polyols; glycidyl esters of polycarboxylic acids; di or poly glycidyl aliphatic or aromatic amines; epoxy compounds obtained from peroxidation of unsaturated compounds; homo and copolymers of glycidyl methacrylate; homo and copolymers of glycidyl acrylate; epoxy acrylate compounds and epoxy methacrylate compounds;

polyunsaturated compounds selected from the group consisting of 2-(acryloxy)ethermethacrylate; ethoxylated bisphenol A di(meth)acrylate; polyethylene glycol di(meth)acrylate; 1,3-butylene glycol di(meth)acrylate; propoxylated neopentyl glycol di(meth)acrylate; alkoxylated aliphatic di(meth)acrylate ester; tris(2-hydroxylethyl)isocyanurate tri(meth)acrylate; pentaerythritol tri(meth)acrylate; glycerol propoxylate tri (meth)acrylate; pentaerythritol tetra(meth)acrylate; dipentaerythritol penta(meth)acrylate; di or in (meth) acrylate methacrylate ester; di or tri (meth)acrylate acrylate ester; aliphatic urethane (meth)acrylate and aromatic urethane (meth)acrylate;

halogen containing compounds selected from the group consisting of epichlorohydrin, epibromohydrin, epiiodohydrin; 2-bromoethyl acrylate; 3-bromopropyl acrylate; 4-bromobutyl acrylate; 6-bromohexyl acrylate; 7-bromoheptyl acrylate; 8-bromooctyl acrylate; 9-bromononyl acrylate; 11-bromoundecyl acrylate; 12-bromododecyl acrylate; 2-chloroethyl acrylate; 2-(2-chloroethoxy) ethyl acrylate; 2-[2-(2-chloroethoxy)ethoxy]ethyl acrylate; 4-chlorobutyl acrylate; 2-chlorocyclohexyl acrylate; 10-chlorodecyl acrylate; 6-chlorohexyl acrylate; 3-chloro-2,2-dimethylpropyl acrylate; 1-chloro-2methyl-2-propyl acrylate; 8-chlorooctyl acrylate; 3-chloropropyl acrylate; 2-bromoethyl isocyanate; 2-chloroethyl isocyanate; 4-chlorobutyl isocyanate and trichloroacetyl isocyanate;

compounds containing at least one halohydrin group and at least one group selected from the group consisting of oxirane, acrylate, methacrylate and aldehyde linked to the halohydrin group by a hydrocarbon linking group; and compounds containing two or more anhydride groups selected from the group consisting of pyrromellitic dianhydride, 1,4,5,8-naphthalenetetracarboxylic dianhydride, 3,4,9,10-perylenetetracarboxylic dianhydride and polymers containing maleic anhydride.

25. A process according to claim 19 herein the weight ratio of polyamine to crosslinking agent is in the range of from 1:100 to 100:1.

26. A process according to claim 19 wherein the weight ratio of polyamine to crosslinking agent is in the range of from 1:10 to 10:1.

27. A process according to claim 19, wherein at least one of the modifying agent and crosslinking agent includes a functional group selected from the group consisting of electroconductive groups, UV absorbing groups, 1R, absorbing groups, charge containing groups and ion exchange groups.

28. A process according to claim 1 wherein the process further includes the step substrate a further material selected from the group consisting of an adhesive, functional molecules, coatings and inks.

29. A process according to claim 1 wherein the modifying agent is delivered with a carrier comprising a solvent or a gas and sprayed into the zone of elevated temperature.

30. A process according to claim 29 wherein the modifying agent and the carrier solvent or gas are preheated prior to the spray delivery into the zone of elevated temperature.

31. A process according to claim 9 wherein the oxidation is provided by treating the surface with a flame burner.

32. A process according to claim 1 wherein the substrate is a polymer based material.

33. A process according to claim 32 wherein the substrate is a polyolefin polymer.

34. A method according to claim 29 wherein the carrier is a gas selected from the group consisting of air, nitrogen, helium, argon and the mixtures thereof.

* * * * *